US010791809B2

(12) United States Patent
Meersschaert et al.

(10) Patent No.: US 10,791,809 B2
(45) Date of Patent: Oct. 6, 2020

(54) LUGGAGE FRAME

(75) Inventors: Reinhard Meersschaert, Merelbeke (BE); Kenzo Yoneno, Pok Fu Lam (HK)

(73) Assignee: Samsonite IP Holdings S.a r.l., Luxembourg (LU)

( * ) Notice: Subject to any disclaimer, the term of this patent is extended or adjusted under 35 U.S.C. 154(b) by 120 days.

(21) Appl. No.: 14/358,235

(22) PCT Filed: Sep. 7, 2012

(86) PCT No.: PCT/EP2012/067502

§ 371 (c)(1),
(2), (4) Date: May 15, 2014

(87) PCT Pub. No.: WO2013/072086

PCT Pub. Date: May 23, 2013

(65) Prior Publication Data

US 2014/0311844 A1 Oct. 23, 2014

Related U.S. Application Data

(60) Provisional application No. 61/560,109, filed on Nov. 15, 2011.

(51) Int. Cl.
*A45C 13/04* (2006.01)
*A45C 5/02* (2006.01)
(Continued)

(52) U.S. Cl.
CPC ..... *A45C 13/04* (2013.01); *A45C 5/02* (2013.01); *A45C 5/03* (2013.01); *A45C 5/14* (2013.01);
(Continued)

(58) Field of Classification Search
CPC .. A45C 13/04; A45C 5/02; A45C 5/14; A45C 13/02; A45C 2005/035
See application file for complete search history.

(56) References Cited

U.S. PATENT DOCUMENTS 1,155,475 A 10/1915 Fay
1,658,201 A * 2/1928 Howland ..... A45C 3/001 190/126
(Continued)

FOREIGN PATENT DOCUMENTS

CN 2200981 Y 6/1995
CN 2208829 Y 10/1995
(Continued)

OTHER PUBLICATIONS

"At the Leading Edge of Luggage Design", Antler Co., catalogue, 4 pages, (2001).
(Continued)

*Primary Examiner* — Tri M Mai
(74) *Attorney, Agent, or Firm* — Dorsey & Whitney LLP

(57) ABSTRACT

A piece of luggage (100, 298) may include front, rear, top, bottom, right, and left sides or faces (102, 104, 106, 108, 110, 112) that define an enclosed space. The enclosed space may be divided into one or more compartments. The luggage piece may further include at least one zipper (124) to access the enclosed space. The at least one zipper may include a zipper track (132), at least one zipper slider (134), and at least one zipper tab (136). The luggage piece may further include a frame (138, 300) that generally defines the shape of the luggage piece. The frame may include upper and lower bodies (140, 142, 144, 146, 302, 304) that are joined together by elongated structural members (148, 150, 306), such as pultrusions or closed wire loops. The upper bodies may substantially define the top side of the luggage piece,
(Continued)

and the lower bodies may substantially define the bottom side of the luggage piece. The upper and lower bodies may be molded, hard bodies.

17 Claims, 17 Drawing Sheets

(51) Int. Cl.
*A45C 13/02* (2006.01)
*A45C 5/14* (2006.01)
*A45C 5/03* (2006.01)

(52) U.S. Cl.
CPC ..... *A45C 13/02* (2013.01); *A45C 2005/035* (2013.01)

(56) References Cited

U.S. PATENT DOCUMENTS

| | | | | |
|---|---|---|---|---|
| 1,722,473 | A * | 7/1929 | Kisling | A45C 5/02 190/126 |
| 2,571,442 | A | 10/1951 | Griffith | |
| 2,710,084 | A | 6/1955 | Braverman | |
| 3,330,389 | A | 7/1967 | Kaplan | |
| 3,447,648 | A | 6/1969 | Schwennicke | |
| 4,383,142 | A | 5/1983 | Kaneko | |
| 4,733,549 | A | 3/1988 | Baker | |
| 4,784,248 | A * | 11/1988 | Workman | A45C 5/02 112/419 |
| 4,813,520 | A | 3/1989 | Lin | |
| 4,901,897 | A | 2/1990 | Briggs et al. | |
| 5,085,320 | A | 2/1992 | Scott | |
| 5,103,975 | A | 4/1992 | Liu | |
| 5,115,895 | A | 5/1992 | Myers | |
| 5,255,765 | A | 10/1993 | Schrecongost | |
| 5,358,082 | A | 10/1994 | Armstrong, IV | |
| 5,393,079 | A | 2/1995 | Wang | |
| 5,522,487 | A | 6/1996 | Nordstrom | |
| 5,535,797 | A | 7/1996 | Martindale | |
| 5,607,129 | A | 3/1997 | Kim | |
| 5,749,446 | A | 5/1998 | Hsieh | |
| 5,875,876 | A | 3/1999 | Wang | |
| 5,918,710 | A | 7/1999 | Sher | |
| 6,021,874 | A | 2/2000 | Nykoluk | |
| 6,026,547 | A | 2/2000 | O'Donnell Kiely | |
| 6,131,713 | A | 10/2000 | Sher | |
| 6,148,973 | A * | 11/2000 | Chang | A45C 5/14 190/115 |
| D444,946 | S | 7/2001 | Klamm | |
| 6,409,283 | B1 | 6/2002 | Hsieh | |
| 6,431,334 | B1 | 8/2002 | Lin | |
| D462,169 | S | 9/2002 | Giovanni | |
| 6,471,104 | B1 | 10/2002 | Janek | |
| 6,502,285 | B2 | 1/2003 | Kiely | |
| 6,591,950 | B1 | 7/2003 | Scicluna | |
| 6,612,413 | B2 * | 9/2003 | Kuwayama | A45C 5/02 190/122 |
| 6,619,447 | B1 | 9/2003 | Garcia, III et al. | |
| 6,651,792 | B1 | 11/2003 | Kuwayama | |
| D493,283 | S | 7/2004 | Rada et al. | |
| 6,966,439 | B2 | 11/2005 | Weleczki | |
| 7,043,780 | B1 | 5/2006 | Cheng | |
| 7,111,714 | B1 | 9/2006 | Bell, III | |
| 7,255,145 | B2 | 8/2007 | Oh | |
| 7,392,888 | B2 * | 7/2008 | Lai | A45C 13/04 190/115 |
| 7,575,376 | B2 | 8/2009 | Yu | |
| D603,163 | S | 11/2009 | Van Himbeeck | |
| 7,621,160 | B2 | 11/2009 | Thomson et al. | |
| 7,743,713 | B2 | 6/2010 | Volk et al. | |
| D629,200 | S | 12/2010 | Turella-Yuan et al. | |
| 7,896,143 | B2 | 3/2011 | Lee | |
| 7,984,797 | B1 | 7/2011 | Bieber | |
| D644,434 | S | 9/2011 | Miles et al. | |
| D644,436 | S | 9/2011 | Buller | |
| D665,997 | S | 8/2012 | Meersschaert | |
| D666,414 | S | 9/2012 | Giovannoni | |
| D675,016 | S | 1/2013 | Van Overbeke | |
| D675,017 | S | 1/2013 | Van Overbeke | |
| 8,727,083 | B2 | 5/2014 | Lai | |
| 2002/0024189 | A1 | 2/2002 | Chen | |
| 2002/0125665 | A1 | 9/2002 | Cohen | |
| 2003/0019705 | A1 | 1/2003 | Lau | |
| 2003/0034215 | A1 | 2/2003 | Lin | |
| 2003/0038009 | A1 | 2/2003 | Chang | |
| 2003/0057046 | A1 * | 3/2003 | Chang | A45C 5/02 190/127 |
| 2004/0045779 | A1 * | 3/2004 | Chen | A45C 13/36 190/37 |
| 2004/0079604 | A1 * | 4/2004 | Martin | A45C 13/262 190/115 |
| 2005/0056511 | A1 | 3/2005 | Hsieh | |
| 2005/0072641 | A1 * | 4/2005 | Chen | A45C 13/36 190/37 |
| 2005/0150732 | A1 * | 7/2005 | Costa | A45C 13/262 190/115 |
| 2006/0124417 | A1 | 6/2006 | O'Shea et al. | |
| 2006/0137951 | A1 | 6/2006 | Lai | |
| 2006/0180422 | A1 | 8/2006 | Lin | |
| 2008/0245633 | A1 | 10/2008 | Chun | |
| 2009/0071781 | A1 | 3/2009 | Lee | |
| 2009/0101460 | A1 | 4/2009 | Justham et al. | |
| 2009/0145710 | A1 | 6/2009 | Roncato | |
| 2009/0242344 | A1 | 10/2009 | Selvi | |
| 2011/0088987 | A1 | 4/2011 | Santy et al. | |
| 2011/0192689 | A1 | 8/2011 | Wang | |

FOREIGN PATENT DOCUMENTS

| | | | | |
|---|---|---|---|---|
| CN | 1132056 | A | 10/1996 | |
| CN | 2245887 | Y | 1/1997 | |
| CN | 1167429 | A | 12/1997 | |
| CN | 1336804 | A | 2/2002 | |
| CN | 2602646 | Y | 2/2004 | |
| CN | 2707084 | Y * | 7/2005 | |
| CN | 201234669 | Y | 5/2009 | |
| CN | 201234670 | Y | 5/2009 | |
| CN | 201798187 | U | 4/2011 | |
| CN | 202341149 | U | 7/2012 | |
| DE | 842531 | C | 6/1952 | |
| DE | 20208648 | U1 | 10/2003 | |
| EM | 000347422-0002 | | 5/2005 | |
| EM | 000425285-0003 | | 10/2005 | |
| EM | 001199392-0002 | | 3/2010 | |
| EP | 0290402 | A1 | 11/1988 | |
| EP | 2043480 | A1 | 4/2009 | |
| EP | 2363037 | A1 | 9/2011 | |
| EP | 2787857 | B1 | 4/2016 | |
| FR | 2542989 | A1 | 9/1984 | |
| FR | 2949950 | A1 | 3/2011 | |
| GB | 580515 | | 9/1946 | |
| GB | 2361692 | A | 10/2001 | |
| GB | 2441580 | A | 3/2008 | |
| GB | 2477087 | A | 7/2011 | |
| JP | S3517480 | U | 7/1960 | |
| JP | 54136107 | U1 | 9/1979 | |
| JP | 55102820 | U1 | 7/1980 | |
| JP | S5824218 | U | 2/1983 | |
| JP | S5877524 | U | 5/1983 | |
| JP | H08507953 | A | 8/1996 | |
| JP | 9-131212 | A | 5/1997 | |
| JP | 3093647 | U | 10/2002 | |
| WO | 9639892 | A1 | 12/1996 | |
| WO | 9944460 | A1 | 9/1999 | |
| WO | 0013542 | A1 | 3/2000 | |
| WO | WO 0013542 | A1 * | 3/2000 | A45C 3/001 |
| WO | 03063637 | A2 | 8/2003 | |
| WO | 2005011430 | A2 | 2/2005 | |
| WO | 2008009905 | A1 | 1/2008 | |
| WO | 2010122259 | A1 | 10/2010 | |

(56) References Cited

FOREIGN PATENT DOCUMENTS

| | | | |
|---|---|---|---|
| WO | 2011033218 | A1 | 3/2011 |
| WO | 2011089376 | A2 | 7/2011 |

OTHER PUBLICATIONS

PCT International Search Report dated Jan. 7, 2013, Application No. PCT/EP2012/067502, 3 pages.
EPO, "Extended European Search Report", Application No. 18184811.0, dated Jun. 28, 2019, 10 pages.
1941 Samsonite Streamlite, obtained from https://www.samsonite.co.uk/our-story/history.html, known as early as May 10, 2018, 1 page.
"Demontage de la valise Streamlite." Hamann, Jean-Christophe. Original submission (in French) by opponent in a European Opposition Proceeding for EP2787857 submitted to the EPO on Feb. 6, 2017. Machine translation in English prepared May 24, 2018, 7 pages.
Response by patent owner in a European Opposition Proceeding for EP2787857 submitted to the EPO on Jan. 24, 2018, 1 page.
Decision of EPO revoking EP2787857 dated Jun. 4, 2018, 11 pages.

* cited by examiner

LUGGAGE FRAME

CROSS-REFERENCE TO RELATED APPLICATIONS

This application is the national stage application of International patent application No. PCT/EP2012/067502, entitled "Luggage Frame," and filed on Sep. 7, 2012, which claims the benefit, under 35 U.S.C. § 119 (e), of U.S. provisional patent application No. 61/560,109, entitled "Frame of Luggage" and filed on Nov. 15, 2011, which are hereby incorporated by reference herein in their entireties.

TECHNOLOGICAL FIELD

The technological field generally relates to luggage.

BACKGROUND

Luggage weight is often an important consideration when designing luggage. All things being equal, consumers generally prefer to purchase the lightest piece of luggage, especially when the luggage piece is intended to be taken onto an airplane. However, there is often a compromise between minimizing the weight of the luggage piece while providing a luggage piece with sufficient durability and structural integrity to maintain its general shape and to withstand the rigors of use. As such, there remains a continued need in the luggage industry to develop luggage pieces that achieve the goal of minimizing the weight of the luggage piece without compromising the structural integrity of the luggage piece.

One approach to reducing the weight of the luggage piece involves utilizing three-dimensional internal frames that support outer and inner fabrics. Examples of various three-dimensional frames or frame-like structures may be found in the following publications: WO Publication No. 2008/009905; GB Publication No. 2 361 692; EP Publication No. 2 363 037; U.S. Pat. No. 6,131,713; WO Publication No. 2011/033218; WO Publication No. 2010/122259; and U.S. Pat. No. 7,984,797. These frames or frame-like structures, however, suffer from various deficiencies.

For example, many three-dimensional frames or frame-like structures are formed using elongated members that are positioned orthogonally to each other. This configuration creates box-like structures that are often visually unappealing. Further, the structures often limit a luggage designer's ability to create interesting shapes and designs for the outer surfaces of luggage pieces that may help to differentiate a designer's luggage pieces from luggage pieces offered by others.

As another example, many three-dimensional frames or frame-like structures require additional members, such as plates or wheel housing connectors, to support desired features such telescoping handles, carry handles, and wheels. The additional pieces may undesirably increase the weight of the luggage or may undesirably increase the complexity of manufacturing or assembling the luggage piece.

Accordingly, there is a need for luggage frames that can address one or more of these and other deficiencies in existing luggage frames.

SUMMARY

One embodiment of a luggage piece may include a base and a lid. The lid may be pivotally joined to the base to pivot between at least a first position where the base and the lid define a substantially enclosed space and a second position that allows for access to the substantially enclosed space. The base may include a frame. The frame may include a first molded, hard body; a second molded, hard body; and at least one first elongated member. The second molded, hard body may be positioned at a portion of the base that is distal from the first molded, hard body. The first molded, hard body may define at least a significant portion of a face of the base, and the second molded, hard body may define at least a significant portion of another face of the base. The first molded, hard body may be joined to the second molded, hard body by the at least one first elongated member.

In some embodiments, a top face of the base is the face of the base that is at least significantly defined by the first molded, hard body. In some embodiments, a bottom face of the base is the another face of the base that is at least significantly defined by the second molded, hard body.

In some embodiments, an outer layer may be joined to the frame. The outer layer may be a fabric or the like. The outer layer may define a central portion of yet another face of the base where the central portion is located between the first and second molded, hard bodies.

In some embodiments, the lid may include a second frame. The second frame may include a third molded, hard body; a fourth molded, hard body; and at least one second elongated member. The fourth molded, hard body may be positioned at a portion of the lid that is distal from the first molded, hard body. The third molded, hard body may define a significant portion of a face of the lid, and the fourth molded, hard body may define a significant portion of another face of the lid. The third molded, hard body may be joined to the fourth molded, hard body by the at least one second elongated member.

In some embodiments, a top face of the lid is the face of the lid that is at least significantly defined by the third molded, hard body. In some embodiments, a bottom face of the lid is the another face of the lid that is at least significantly defined by the fourth molded, hard body.

In some embodiments, the luggage piece may further include a liner positioned within the enclosed space and joined to either the frame or the second frame by joining the liner to at least one of either the at least one first elongated member or the at least one second elongated member.

In some embodiments, each of the first and second molded, hard bodies may define portions of at least two other faces of the luggage piece. The at least two other faces may be selected from group consisting of the following: a front face, a rear face, a left face, or a right face of the luggage piece.

In some embodiments, the luggage piece may include a connector. The connector may include a main body defining a curved channel, a partial collar extending from the main body, and a protrusion positioned proximate to the partial collar and extending from the main body generally parallel to the main collar. At least a portion of either the first molded, hard body or the second molded, hard body may be received within the curved channel. At least a portion of the protrusion may be received through an opening defined by one of the at least one first elongated member.

Another embodiment of a luggage piece may include a front side, a rear side, a right side, a left side, a top side, and a bottom side. The front, rear, right, left, top and bottom sides may define an enclosed space. A zipper may be positioned along at least portions of the right, left, top, and bottom sides. The zipper and the right, left, top, and bottom sides may be configured so that the zipper provides access to the enclosed space. The luggage piece may further include a frame. The frame may include a first upper body, a second upper body, a first lower body, and a second lower body. The first lower body may be operatively joined to the first upper body by at least one first elongated member. The second lower body may be operatively joined to the second upper body by at least one second elongated member. The first and second upper bodies may collectively define a substantial portion of the top side of the luggage piece. In some embodiments, the first and second lower bodies may collectively define a substantial portion of the bottom side of the luggage piece.

In some embodiments, the first upper body defines at least a portion of the right, left and front sides of the luggage piece and/or the second upper body defines at least a portion of the right, left and rear sides of the luggage piece.

In some embodiments, the first lower body defines at least a portion of the right, left and front sides of the luggage piece, and/or the second lower body defines at least a portion of the right, left and rear sides of the luggage piece.

In some embodiments, the at least one first elongated member comprises a fiberglass pultrusion.

Another embodiment of a luggage piece may include a base, a lid, and a frame. The lid may be pivotally joined to the base to pivot between at least a first position where the base and the lid define a substantially enclosed space and a second position to allow access to the substantially enclosed space. The frame may include a first upper body and a first lower body. The first upper body may define an upper portion of the lid. The first lower body may defines a lower portion of the lid. The first lower body may be operatively joined to the first upper body by at least one first elongated member.

In some embodiments, the frame may further include a second upper body that defines an upper portion of the base and a second lower body that defines a lower portion of the base. The second lower body may be operatively joined to the second upper body by at least one second elongated member.

In some embodiments, the second upper body may define a substantial portion of a top side of the base, and/or the second lower body may define a substantial portion of a bottom side of the base.

In some embodiments, the first upper body may define a substantial portion of a top side of the lid, and/or the first lower body may define a substantial portion of a bottom side of the lid.

In some embodiments, the at least one first elongated member may be a fiberglass pultrusion.

In some embodiments, the luggage piece may include an outer layer joined to the frame. The outer layer may define a central portion of the luggage piece where the central portion is located between the upper bodies and the lower bodies. The outer layer may be fabric.

In some embodiments, a liner may be positioned within the enclosed space and joined to the frame. The liner may be joined to at least one of either the at least one first elongated member or the at least one second elongated member. A first flap and a second flap may be joined to the liner. The first flap and the second flap may be configured to be selectively connected and disconnected from each other. A connection mechanism may be joined to the first flap and the second flap and configured to selectively connect and disconnect the first flap and second flap. The first flap, the second flap, and an interior surface of the luggage piece may collectively define a substantially enclosed area within the enclosed space when the first and second flaps are connected together.

Another embodiment of a luggage piece may include a base and a lid. The lid may be pivotally joined to the base to pivot between at least a first position where the base and the lid define a substantially enclosed space and a second position that allows for access to the substantially enclosed space. Either the base or the lid may include a first flap, a second flap, and a connection mechanism. The connection mechanism may be joined to the first flap and the second flap. The connection mechanism may be configured to selectively connect and disconnect the first flap and second flap. The first flap, the second flap, and an interior surface of the luggage piece may collectively define a substantially enclosed area within the enclosed space when the first and second flaps are connected together.

This summary is provided to aid in understanding the luggage piece, and one of skill in the art will understand that each of the various aspects and features of the luggage piece may advantageously be used separately in some instances, or in combination with other aspects and features of the luggage piece in other instances.

DETAILED DESCRIPTION

Described herein are luggage pieces that incorporate a frame to provide shape and structural support to the luggage piece. The luggage pieces may include front, rear, top, bottom side, right, and left sides that define an enclosed space. The enclosed space may be divided into one or more compartments. The luggage pieces may further include at least one zipper to access the enclosed space. The at least one zipper may include a zipper track, at least one zipper slider, and at least one zipper tab. The luggage pieces may further include a frame that provides shape to the luggage piece. The frame may include main bodies joined by structural elements. The frame may generally define the shape of the luggage. Inner and outer layers of materials may be joined to the frame to define one or more of the lid and the base, or other shells, of the luggage pieces.

Figure 1:
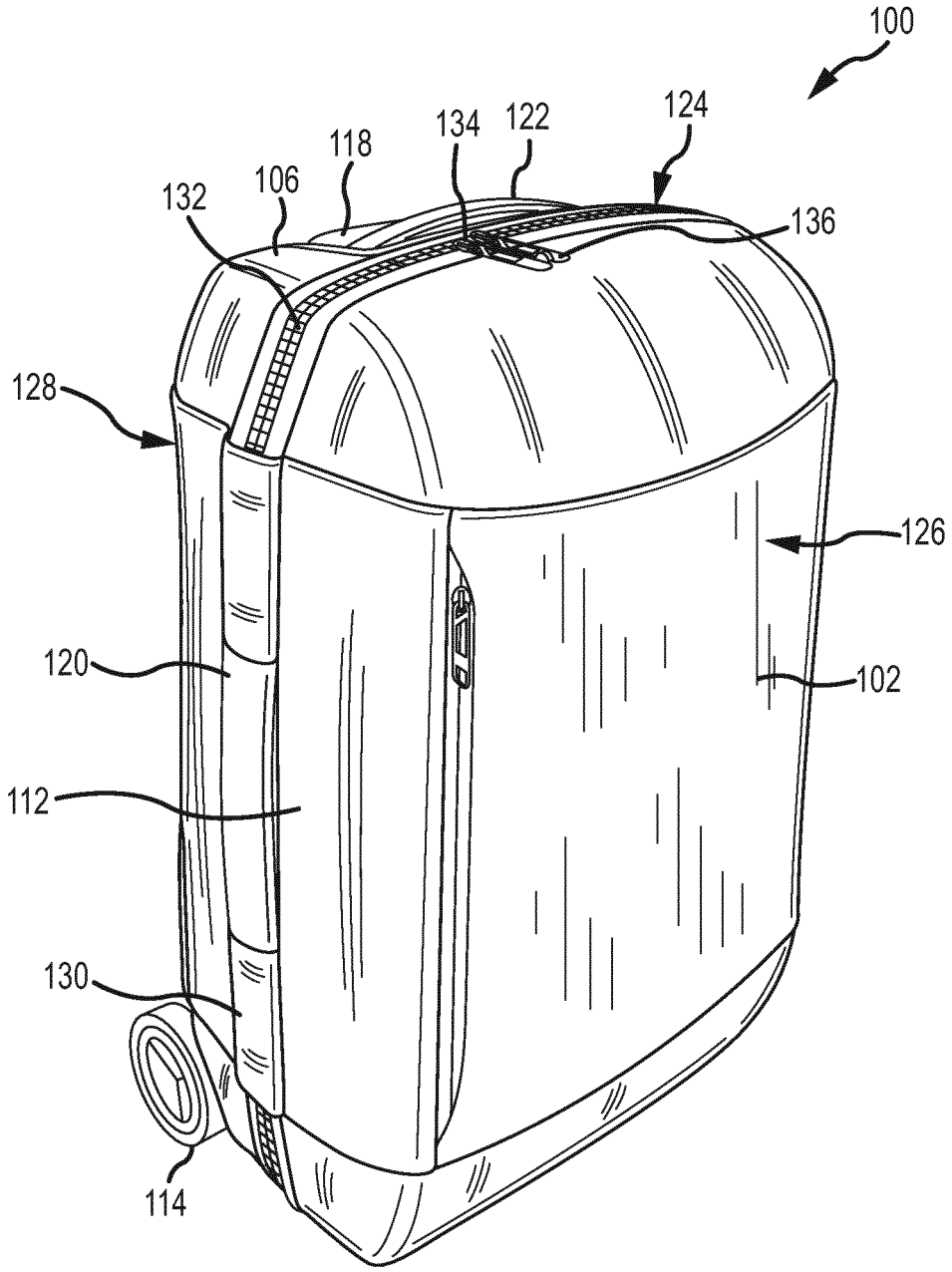
FIG. 1 shows a perspective view of a luggage piece.
Figure 2:
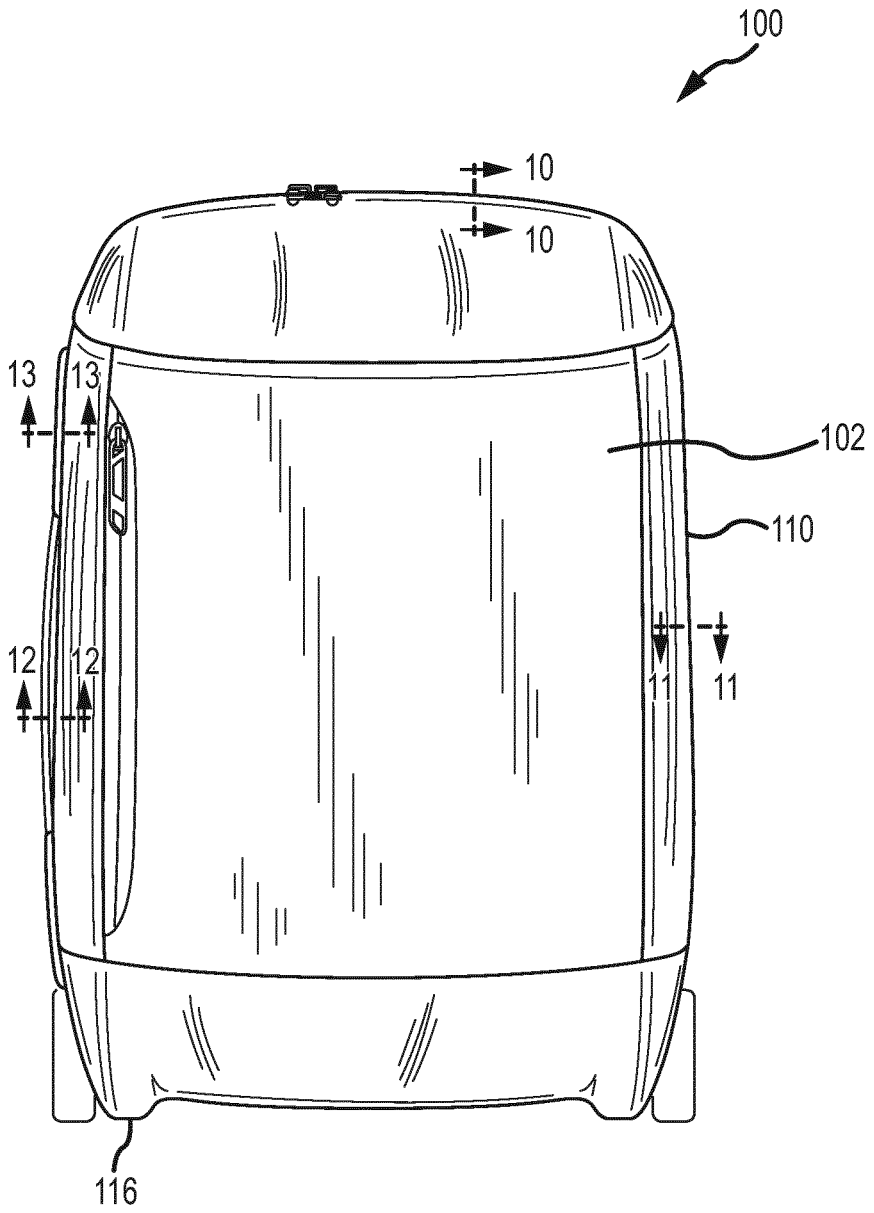
FIG. 2 shows a front elevation view of the luggage piece shown in FIG. 1
Figure 3:
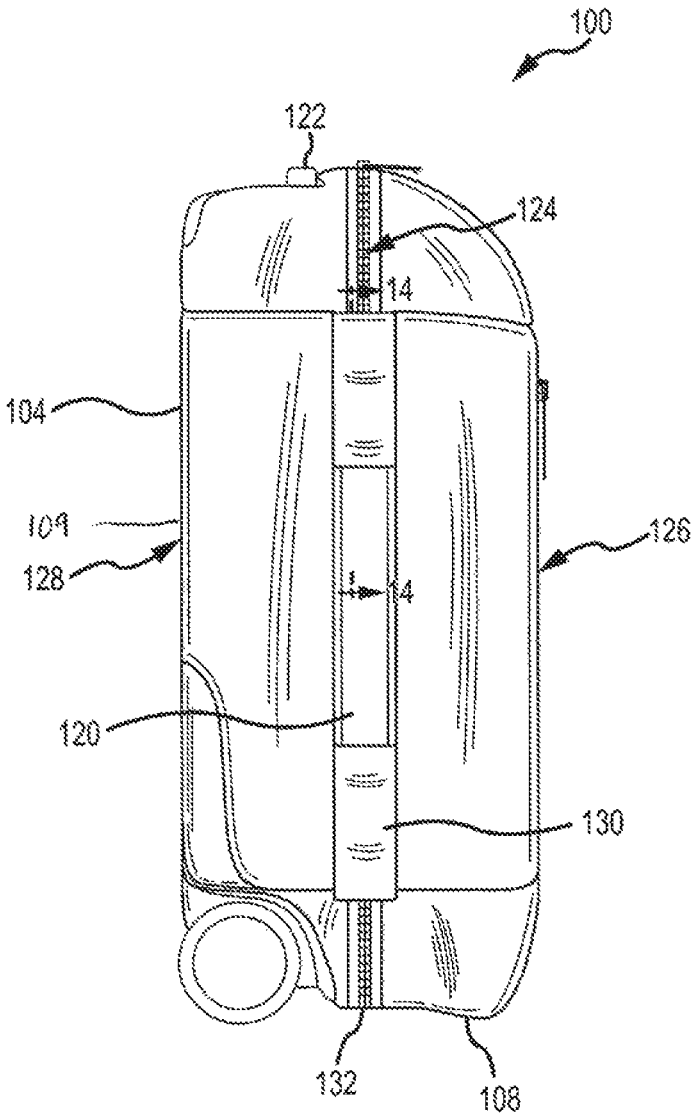
FIG. 3 shows a side elevation view of the luggage piece shown in FIG. 1.
Figure 4:
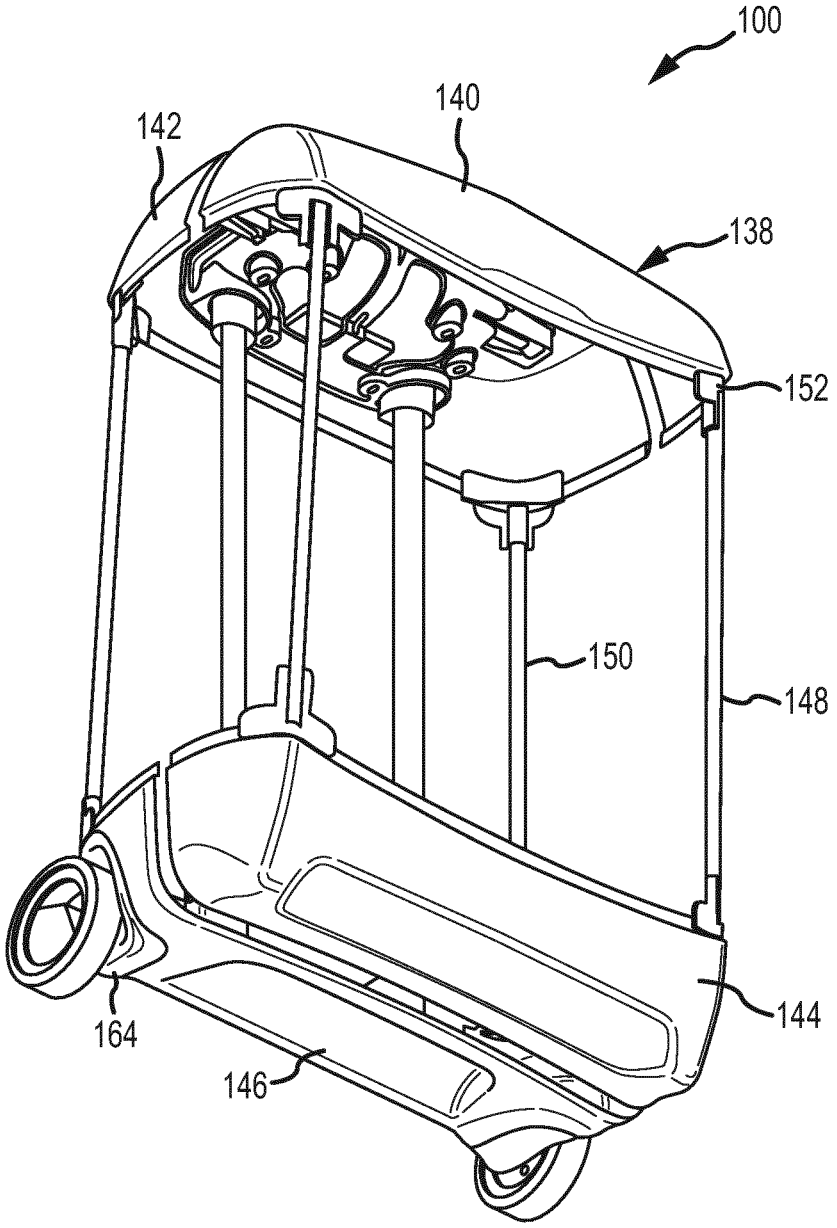
FIG. 4 shows a perspective view of a frame for the luggage piece shown in FIG. 1.
Figure 5:
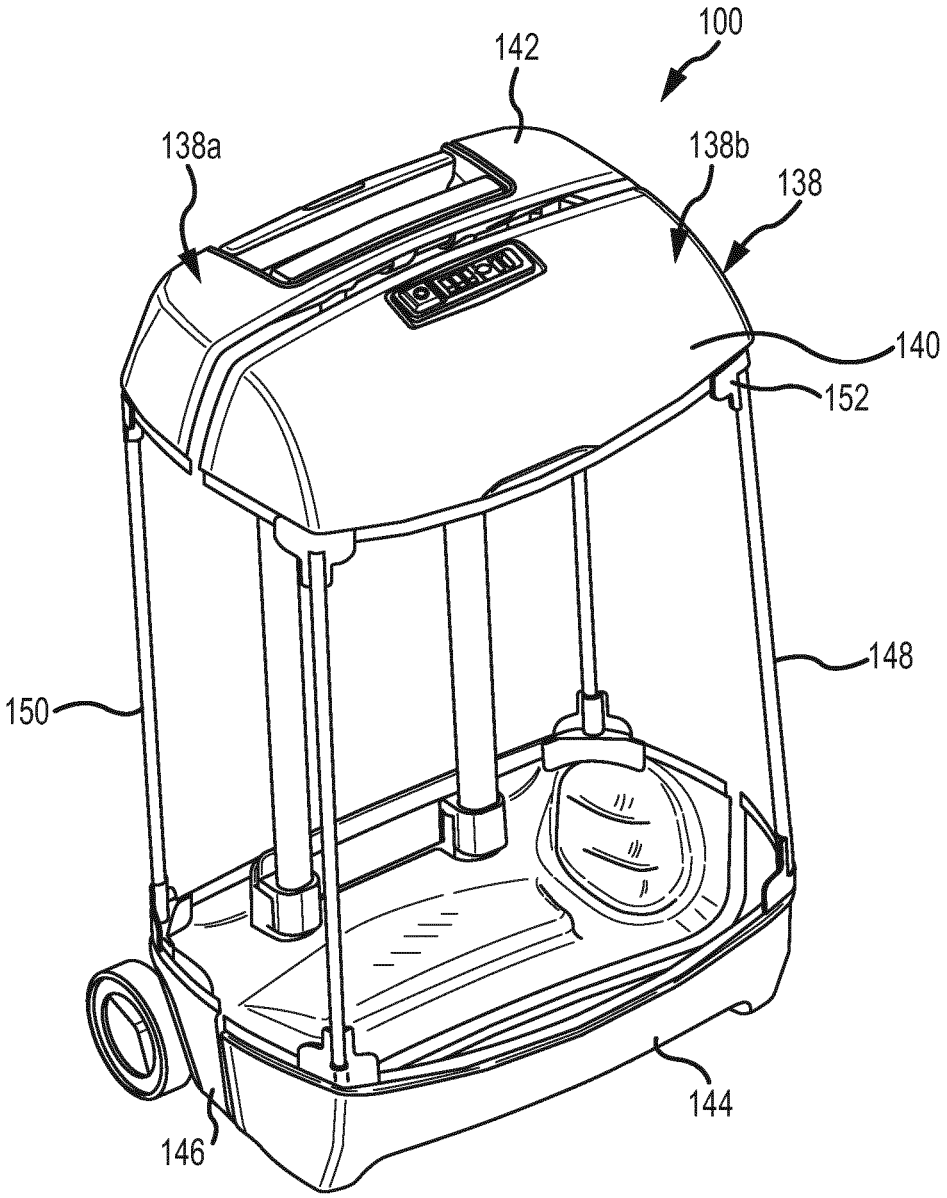
FIG. 5 shows another perspective view of the frame shown in FIG. 4.

FIG. 1 shows a front perspective view of one example of a luggage piece 100 that utilizes a frame, FIG. 2 shows a front elevation view of the luggage piece 100 shown in FIG. 1, and FIG. 3 shows a side elevation view of the luggage piece 100 shown in FIG. 1. With reference to FIGS. 1-3, the luggage piece 100 may include a front side or face 102, a rear side or face 104, a top side or face 106, a bottom side or face 108, a right side or face 110, and a left side or face 112 that define an enclosed space (not shown). The enclosed space may be divided into one or more compartments. The luggage piece 100 may further include one or more wheels 114 joined to the bottom side or face 108 of the luggage piece. The wheels 114 may be fixed direction wheel, as shown in FIG. 1, or spinner wheels. While two wheels 114 are shown in the figures, the luggage piece 100 may have more or less than two wheels. In embodiments that use two wheels, one or more feet 116 or other supports may be positioned proximate to the bottom side or face 108 of the luggage piece to facilitate positioning and maintaining the luggage piece 100 in an upright position, similar to the upright position for the luggage piece 100 shown in FIGS. 1-3.

The luggage piece 100 may further including one or more handles. At least one of the handles may be a telescoping handle 118 that may be selectively positioned between a retracted position and one or more extended positions. In an extended position, the telescoping handle 118 may be used to facilitate using the wheels 114 to push or pull the luggage piece 100 along a support surface. One or more of the handles may be carry handles 120, 122. In FIG. 1, two carry handles are shown: one joined to top side or face 106 of the luggage piece 100, and the other to the left side or face 112 of the luggage piece 100. The carry handles 120, 122 may be used to lift or carry the luggage piece 100. Of course, more or less than two carry handles 120, 122 could be joined to the luggage piece 100.

The luggage piece 100 may further include a first zipper 124 that provides access to the enclosed space. More particularly, the front side or face 102 and portions of the top, bottom, right and left sides or faces 106, 108, 110, 112 of the luggage piece 100 may be joined to define a first luggage portion or a first shell 126 of the luggage piece 100 that can move in unison. Similarly, the rear side or face 104 and portions of the top, bottom, right and left sides or faces of the luggage piece 100 may define a second luggage portion or a second shell 128 of the luggage piece 100 that move in unison. The first luggage portion or first shell 126 may also be referred to as a lid 126, and the second luggage portion or second shell 128 may be referred to as a base 128. The first and second luggage portions 126, 128 may be joined by a hinge 130 that allows them to be selectively pivoted relative to each other to different configurations while remaining joined via the hinge 130. In the configuration shown in FIG. 1, the first and second luggage portions 126, 128 collectively define the enclosed spaced. When pivoted to other positions where the abutting edges of first and second luggage portions 126, 128 are separated, the enclosed space may be accessed.

The first zipper 124 may be positioned along the abutting edges of the first and second luggage portions 126, 128. The first zipper 124 may include a zipper track 132, two zipper sliders 134, and two zipper tabs 136. Each zipper tab 136 may be joined to a respective zipper slider 134 to facilitate selectively moving its respective zipper slider 134 along the zipper track 132. The zipper track 132 may be positioned along the abutting edges of the first and second luggage portions 126, 128 from at least one end portion of the hinge to the distal end portion of the hinge 130. For example, the zipper track 132 may extend from at least an upper end portion of the hinge 130 to the top side or face 106 of the luggage piece 100, along the top side or face 106 of the luggage piece 100 to the right side or face 110 of the luggage piece 100, along the right side or face 110 of the luggage piece 100 to the bottom side or face 108 of the luggage piece 100, along the bottom side or face 108 of the luggage piece 100 to the left side or face 112 of the luggage piece 100, and along the left side or face 112 of the luggage piece 100 to at least a lower end portion of the hinge 130.

With reference to FIG. 1, the zipper track 132 may include a first set of teeth joined to a first zipper tape and a second set of teeth joined to a second zipper tape. The first set of teeth may be joined to the edge of the first luggage portion 126 that abuts the second luggage portion 128, and the second set of teeth may be joined to the edge of the second luggage portion 128 that abuts the first luggage portion 126. The first and second sets of teeth may be joined to the first and second luggage portions 126, 128 respectively, by any suitable connection method, including, but not limited to, by sewing, bonding, adhering, welding, and so on.

The teeth of the first set of teeth may be configured to selectively engage corresponding teeth on the second set of teeth. Selectively moving the zipper sliders 134 along the zipper track 132 causes the teeth of the first and second sets of teeth to be selectively engaged and disengaged. When one or both of the zipper sliders 134 are moved away from each other, at least some of the teeth in the first and second sets of teeth are disengaged, thus creating an opening in the zipper track 132. When a sufficient number of teeth in the first and second sets of teeth are disengaged, the opening is sufficiently large to allow access to the enclosed space defined by the first and second luggage portions 126, 128. When the teeth of the first and second sets of teeth along substantially the entire length of the zipper track 132 are disengaged, the first luggage portion 126 may be selectively pivoted relative to the second luggage portion 128, or vice versa. Similarly, when a substantial majority of the teeth of the first and second sets of teeth are engaged, the first and second luggage portions 126, 128 cannot be selectively pivoted relative to each other.

While two zipper sliders 134 are shown in the various figures to open and close the luggage piece 100, the first zipper 124 may only include one zipper slider 134. When the first zipper 124 includes a single zipper slider 134, moving the zipper slider in one direction engages the teeth of the first and second sets of teeth and moving the zipper slider in the opposite direction disengages the teeth. Thus, when the single zipper slider 134 is positioned at one end of the zipper track 132, substantially all of the teeth in the first and second sets of teeth are disengaged, and when the single zipper slider 134 is positioned at the other end of the zipper track 132, substantially all of the teeth for the first and second sets of teeth are engaged. In other respects, the first zipper 124 with a single zipper slider 134 operates in a similar manner as a first zipper 124 with two zipper sliders 134. Specifically, when all teeth of the first and second sets of teeth are engaged, access to the enclosed space is prevented. When a sufficient number of teeth of the first and second sets of teeth are disengaged, the enclosed space may be accessed. When substantially all of the teeth of the first and second sets of teeth are disengaged, the first and second luggage portions 126, 128 may be selectively pivoted relative to each other.

At least a portion of the zipper track 132 may be recessed relative to the outer surfaces of the first and second luggage portions 126, 128. In some embodiments, the zipper track 132 may be recessed along one or more portions or segments of the zipper track's length. In other embodiments, the zipper track 132 may be recessed along the entire length of the zipper track 132.

The upper and lower portions of the luggage piece 100 (i.e., the top and bottom sides or faces 106, 108 of the luggage piece 100 along with portions of the front, rear, right, and left sides or faces 102, 104, 110, 112 of the luggage piece 100 adjacent the top and bottom sides or faces 106, 108) may be formed using a harder material, such as acrylonitrile-butadiene-styrene ("ABS") plastic, polycarbonate plastic, an ABS/polycarbonate plastic blend, and so on. The remaining or central portions 109 of the front, rear, right, and left sides or faces 102, 104, 110, 112 may be formed using a relatively soft or pliable material, such as fabric or the like. In these "softer" regions, second support members, such as ABS plastic sheets or strips, may be provided at the right and left sides or faces 110, 112 of the luggage piece 100 proximate to the first zipper 124 to help to maintain the shape of the luggage piece 100 in these regions and to also facilitate recessing at least a portion of the first zipper 124 relative to the outermost surfaces of the right and left sides 110, 112 of the luggage piece 100.

The harder material defining the top and bottom portions of the luggage piece 100 may define the outer surface of the luggage piece 100 at the upper and lower portions of the luggage piece 100. In some embodiments, a softer material, such as an outer fabric or the like, may be joined to the outer facing surface of the harder material to enhance the look or the feel of the luggage piece 100.

Turning the FIGS. 4-7, the softer materials used to form the luggage piece 100 are omitted to show some of the harder materials used for the upper and lower portions of the luggage piece 100. These harder materials may be part of a luggage frame 138 for the luggage piece 100. The luggage frame 138 may generally define the shape of the luggage piece 100 and may further provide the structural strength to maintain the luggage piece 100 in the desired shape. The luggage frame 138 may also be utilized to support the softer materials of the luggage piece 100.

The luggage frame 138 may include first and second upper bodies 140, 142, first and second lower bodies 144, 146, and front and rear structural elements 148, 150. The first and second upper bodies 140, 142 and the first and second lower bodies 144, 146 could also be referred to as first, second, third, and fourth bodies, with any of the first and second upper bodies and first and second lower bodies possibly being the first body, the second body, the third body, or the fourth body depending upon the context. Thus, the use of the terms "first upper body", "second upper body", "first lower body" and "second lower body" should be understood, unless the specific context indicates otherwise, as arbitrary labels that are used to facilitate the reader's understanding of the luggage frame 138. The front and rear structural elements 148, 150 could also be referred to as first and second structural elements, with any of the front and rear structural elements possibly being the first and second structural elements depending upon the context. Thus, the use of the terms "front structural element" and "rear structural element" should be understood, unless the specific context indicates otherwise, as arbitrary labels that are used to facilitate the reader's understanding of the luggage frame 138. Further, while two front structural elements 148 and two rear structural elements 150 are shown in the figures, more or less than two front structural elements 148 and two rear structural elements 150 may be used.

The luggage frame 138 may include a first frame **138*a* for the base or the second luggage portion 128 and a second frame 138*b* for the lid or the first luggage portion 126. The first frame 138*a* may include the second upper and lower bodies 142, 146 and the rear structural elements 150. The second frame 138*b* may include the first upper and lower bodies 140, 144 and the front structural elements 148**.

The upper and lower bodies 140, 142, 144, 146 may be formed from a harder material, such as ABS or polycarbonate plastic. Each body 140, 142, 144, 146 may be formed using a molding or other suitable process to define a desired outer shape for the upper and lower portions of the luggage piece 100. If desired, each body 140, 142, 144, 146 may be molded or otherwise formed to be a unitary body. Thus, in at least some embodiments, the first and second upper bodies 140, 142 and the first and second lower bodies 144, 146 are molded, hard bodies.

The first upper body 140, which may be a molded, hard body, may define portions of the front, top, right, and left sides or faces 102, 106, 110, 112 of the luggage piece 100. In some embodiments, the first upper body 140 may define at least a significant portion (e.g., approximately 75 percent or more) of the top side or face 106 of the lid or first luggage portion 126. In some of these embodiments, the first upper body 140 may define substantially the entire portion (e.g., approximately 95 percent or more) of, and/or be substantially co-extensive with, the top side or face 106 of the lid or first luggage portion 126. In some embodiments, the first upper body 140 may define at least approximately 5 percent or more of one or more of the front, right, and left sides or faces 102, 110, 112 of the lid or first luggage portion 126.

The second upper body 142, which may be a molded, hard body, may define portions of the rear, top, right, and left sides or faces 104, 106, 110, 112 of the luggage piece 100. In some embodiments, the second upper body 142 may define at least a significant portion (e.g., approximately 75 percent or more) of the top side or face 106 of the base or second luggage portion 128. In some of these embodiments, the second upper body 142 may define substantially the entire portion (e.g., approximately 95 percent or more) of, and/or be substantially co-extensive with, the top side or face 106 of the base or second luggage portion 128. Yet further, in some embodiments, the first upper body 140 and the second upper body 142 may collectively define a substantial portion (e.g., approximately 75 percent or more) of the top side or face 106 of the luggage piece 100. In yet further embodiments, the first upper body 140 and the second upper body 142 may collectively define substantially the entire portion (e.g., approximately 95 percent or more) of, and/or be substantially co-extensive with, the top side or face 106 of the luggage piece 100. In some embodiments, the second upper body 142 may define at least approximately 5 percent or more of one or more of the rear, right, and left sides or faces 104, 110, 112 of the base or second luggage portion 128.

The first lower body 144, which may be a molded, hard body, may define portions of the front, bottom, right, and left sides or faces 102, 108, 110, 112 of the luggage piece 100. In other words, the first lower body 144 may be located at a portion of the lid or first luggage portion 126 of the luggage piece 100 that is distal from the first upper body 140. In some embodiments, the first lower body 144 may define at least a significant portion (e.g., approximately 75 percent or more) of the bottom side or face 108 of the lid or first luggage portion 126. In some of these embodiments, the first lower body 144 may define substantially the entire portion (e.g., approximately 95 percent or more) of, and/or be substantially co-extensive with, the bottom side or face 108 of the lid or first luggage portion 126. In some embodiments, the first lower body 144 may define at least approximately 5 percent or more of one or more of the front, right, and left sides or faces 102, 110, 112 of the first luggage portion 126.

The second lower body 146, which may be a molded, hard body, may define portions of the rear, bottom, right, and left sides or faces 104, 108, 110, 112 of the luggage piece 100. In other words, the second lower body 146 may be located at a portion of the base or second luggage portion 128 of the luggage piece 100 that is distal from the second upper body 142. In some embodiments, the second lower body 146 may define a significant portion (e.g., approximately 75 percent or more) of the bottom side or face 108 of the base or second luggage portion 128. In some of these embodiments, the second lower body 146 may define substantially the entire portion (e.g., approximately 95 percent or more) of, and/or be substantially co-extensive with, the bottom side or face 108 of the base or second luggage portion 128. Further, in some embodiments, the first lower body 144 and the second lower body 146 may collectively define a substantial portion (e.g., approximately 75 percent or more) of the bottom side or face 108 of the luggage piece 100. In yet further embodiments, the first lower body 144 and the second lower body 146 may collectively define substantially the entire portion (e.g., approximately 95 percent or more) of, and/or be substantially co-extensive with, the bottom side or face 108 of the luggage piece 100. In some embodiments, the second lower body 146 may define at least approximately 5 percent or more of one or more of the rear, right, and left sides 104, 110, 112 or faces of the base or second luggage portion 128.

Each structural element 148, 150 may be an elongated member or pultrusion. In some embodiments, each elongated member or pultrusion may be hollow along its longitudinal axis. In other embodiments, each elongated member or pultrusion may be solid along its longitudinal axis. The structural elements 148, 150 may be formed from fiberglass or any other suitable material that provides sufficient compressive strength.

Each front structural element 148 may be joined to, and span between, the first upper body 140 and the first lower body 144. In this configuration, the front structural elements 148 operatively join the first upper body 140 to the first lower body 144. The front structural elements 148 also help to maintain the distance between the first upper body 140 and the first lower body 144. In particular, the front structural elements 148 resist movement of the first upper body 140 towards the lower body 144 and also resist lateral movements the first upper body relative to the first lower body 144.

The front structural elements 148 may be joined to the first upper body 140 and the first lower body 144 using front structural connectors 152. Each front structural connector 152 may be integrally formed with its respective first upper body 140 and first lower body 144, or each front structural connector 152 may be formed as a separate component and then be suitably joined (for example, but not limited to, by friction fitting, welding, mechanical fastening, stitching, adhering, or some combination thereof) to its respective first upper body 140 or first lower body 144. When not integrally formed with a respective first upper body 140 or first lower body 144, each front structural connector 152 may include a main body 154 that defines a connector channel 156 or the like. The connector channel 156 may be generally arcuate shaped along its length to match a curved flange 158 defined by a respective first upper body 140 or first lower body 144. The flange 158 or other portion of the respective first upper body 140 or first lower body 144 may be positioned within the connector channel 156.

In some embodiments, mechanical fasteners, such as stitches, screws, and so on, may then be passed, if desired, through the flange 158 and the portions of the main body 154 of the front structural connector 148 defining the connector channel 156 to join the front structural connector 148 to a respective first upper body 140 or first lower body 144. In some embodiments, the connector channel 156 and the flange 158 of the respective first upper body 140 or first lower body 144 may be sized to create a friction fit connection between the front structural connector 152 and its respective first upper body 140 or first lower body 144. In some embodiments, an adhesive may be placed on the flange 158 of the respective first upper body 140 or first lower body 144 and/or within the connector channel 156 to adhesively join the front structural connector and its respective first upper body 140 or first lower body 144. In some embodiments, some combination of mechanical fasteners, friction fit connections, adhesives, and other connection mechanisms may be used to join the front structural connector 152 and its respective first upper body 140 or first lower body 144.

The main body 154 of each front structural connector 152 may further define a connector flange 160. The connector flange 160 may generally define a portion of the connector channel 156. The connector flange 160 may further be generally arcuate in shape or any other shape that generally matches an inner surface of a respective first upper body 140 or first lower body 144 proximate to the flange 158 of the first upper body 140 or the first lower body 144 and may be configured to abut this inner surface when the flange 158 of the first upper body 140 or first lower body 144 is received within the connector channel 156. The connector flange 160 may further engage its respective first upper body 140 or first lower body 144 to help distribute to the first upper body 140 or the first lower body 144 lateral forces that are imposed on the structural element 148 and transferred to the first upper body 140 or first lower body 144 via the front structural connector 152. To brace the connector flange, the main body 154 may further include a generally triangular shaped (or other suitably shaped) bracing portion 161 (shown best on one of the rear structured connectors 150) that is joined to the connector flange 160 proximate to the portion of the connector flange 160 that defines the connector channel 156. The bracing portion 161 may also define a portion of the connector channel 156.

Each front structural connector 152 may define an area for receiving an end portion of a respective front structural element 148. For each front structural connector 152, the area may be defined by the main body 154 of the front structural connector 152. The main body 154 may further define an arc-shaped partial collar 163 or the like that may extend a pre-determined distance away from the main body 154 of the front structural connector 152 proximate to the area. While shown as a partial collar 163, the collar 163 may be configured to define a cylindrical structure or the like, if desired. The collar 163 may be configured to abut a portion of the front structural element 148 adjacent to the end portion of the front structural element 148 received within the area of the front structural connector 152. The relative positions of the front structural connector 148 and its respective first upper or lower body 140, 144 and front structural element 152 may be arranged so that the collar 163 limits movement of the front structural element 148 towards the interior or enclosed space of the luggage piece 100. Further, the distance that the collar 163 extends from the main body 154 of the front structural connector 152 may be selected so as to provide sufficient support to the front structural element 148 to minimize the risk that the front structural element 148 will buckle towards the interior or enclosed space of the luggage piece 100.

In some embodiments, the area for receiving the front structured element 148 may be recessed. In these embodiments, friction fit, mechanical or adhesive connections between the front structural elements 148 and the front structural connectors 152 may be omitted, if desired, since the recessed area and collar 163 configuration of the front structural connectors 152 keeps the front structural elements 148 joined to the front structural connectors 152 so long as the first upper body 140 and the first lower body 144 are not moved away from each other. The softer materials joined to the first upper body 140 and the first lower body 144, which define the softer central portion of the lid or first luggage portion 126 of the luggage piece 100, function to prevent the first upper body 140 and the second lower body 144 from being moved away from each. However, if desired, mechanical fasteners or adhesives may be utilized to join the front structural elements 148 to the front structural connectors 152, or the front structural elements 148 and the front structural connectors 152 may be sized to create friction fit connections between the front structural elements 148 and the front structural connectors 152.

In some embodiments, each front structural connector 152 may include a protrusion or other projection 165 sized for receipt within the hollow space defined by a respective front structural element 148. The protrusion or other projection 165 may be positioned to extend away from the area that receives the end portion of the front structural element 148. The protrusion or other projection may generally extend away from the area in the same direction that the collar 163 extends away from the area. The protrusion or other projection 165 may be generally cylindrical in shape and may have a pointed or partial spherical free end. If pointed, the free end may be curved to form a relatively blunt free end. If desired, the protrusion or other projection 165 may be formed on a front structural element 148 and a corresponding recess may be defined by the front structural connector 152 to receive the protrusion or other projection 165.

Use of the protrusions and recesses allows for the front structural elements 148 to be joined to the first upper body 140 and the first lower body 144 without requiring mechanical fasteners or adhesives to keep the front structural elements 148 joined to the first upper body 140 and the first lower body 144. Further, friction fit connections between the front structural elements 148 and the front structural connectors 152 are not required since the recess and protrusion configuration keeps the front structural elements 148 joined to the front structural connectors 152 so long as the first upper body 140 and the first lower body 144 are not moved away from each other. As described above, the softer materials joined to the first upper body 140 and the first lower body 144 prevent the first upper body 140 and the second lower body 144 from being moved away from each.

Each rear structural element 150 may be joined to, and span between, the second upper body 142 and the second lower body 146. In this configuration, the rear structural elements 150 operatively join the second upper body 142 to the second lower body 146. The rear structural elements 150 also help to maintain the distance between the second upper body 142 and the second lower body 146. In particular, the rear structural elements 150 resist movement of the second upper body 142 towards the second lower body 146 and also resist lateral movements of the second upper body 142 relative to the second lower body 146.

The rear structural elements 150 may be joined to the second upper body 142 and the second lower body 146 using rear structural connectors 162. Each rear structural connector 162 may be integrally formed with its respective second upper body 142 and second lower body 146, or each rear structural connector 162 may be formed as a separate component and then suitably joined, for example, by welding, mechanical fastening, stitching, or adhering, to its respective second upper body 142 or second lower body 146. Each rear structural connector 162 may be similar in shape to the front structural connectors 152, and each rear structural element 150 may be joined to a respective rear structural connector 162 using techniques similar to the techniques used to join each front structural element 148 to a respective front structural connector 152.

Each rear structural connector 162 joined to the second lower body 146 may be positioned proximate to a wheel housing 164 for the luggage piece 100. Each wheel housing 164 may be positioned proximate to a lower rear portion of the luggage piece 100. Further, one wheel housing 164 may be located near the right side 110 of the luggage piece 100, and the other wheel housing may be located near the left side 112 of the luggage piece 100.

Any of the upper and lower bodies 140, 142, 144, 146 may include one or more recessed areas. For example, the first upper body 140 may define a lock recess area 166 sized to receive a lock mechanism 168 therein. The lock mechanism 168 may be used to selectively secure the zipper tabs 136 of the main zipper 124 to the lock mechanism 168. When the zipper tabs 136 of the main zipper 124 are secured to the lock mechanism 168, access to the enclosed space via the main zipper 124 may be prevented since the zipper tabs 136 are prevented from being utilized to move the zipper sliders 134 along the zipper track 132. Further, the locking mechanism 168 may be configured to prevent the zipper tabs 136 from being unsecured from the locking mechanism 168 unless a correct number combination or other code associated with the locking mechanism 168 is entered.

As another example, the second upper body 142 may define a handle recessed area 170. An upper assembly 172 for the telescoping handle 118 may be joined to the second upper body 142 proximate to the handle recessed area 170. The handle recessed area 170 and the telescoping handle 118 may be configured so that the telescoping handle 118 does not extend beyond the uppermost surface of the top side 106 of the luggage piece 100 when the telescoping handle 118 is positioned in its fully retracted configuration.

As yet another example, the second lower body 146 may define wheel housing recessed areas 174. These wheel housing recessed areas 174 may be located on the right and left sides 110, 112 of the second lower body 146. The wheel housing recessed areas 174 may be configured to match the shape of a respective wheel housing 146. The wheel housing recessed areas 174 may further be sized so that a respective wheel housing 146 does not extend between the outermost surface of the base or second luggage portion 128 of the luggage piece 100.

With continued reference to FIGS. 4-7, a lower telescoping handle support 176 may be joined to, or formed integral with, the second lower body 146. The second lower body 146 may also be joined to the wheels 114 via the wheel housings 164. Thus, when a user utilizes the telescoping handle 118 to roll the luggage piece 100 along a surface using the wheels by pushing or pulling on the telescoping handle 118, the forces imposed on the telescoping handle 118 by the user pushing or pulling on the telescoping handle are transmitted to the second lower body 146 via the lower telescopic handle support 176. The lower telescoping handle support 176 may be joined to the second lower body 146 by mechanical fasteners, welds, adhesives or any other suitable connection mechanism, or may be integrally formed as part of the second lower body 146.

Any of the upper and lower bodies 140, 142, 144, 146 may further include projections or the like. For example, the first lower body 144 may include foot projections 178 that are positioned proximate to the right and left side sides 110, 112 of the luggage piece 100. Each foot projection 178 may further be positioned at the bottom side 108 of the luggage piece 100 and may project downward from the bottom side 108 of the luggage piece 100. The foot projections 178 may further be sized and configured to function as the feet 116 for the luggage piece 100.

Figure 8:
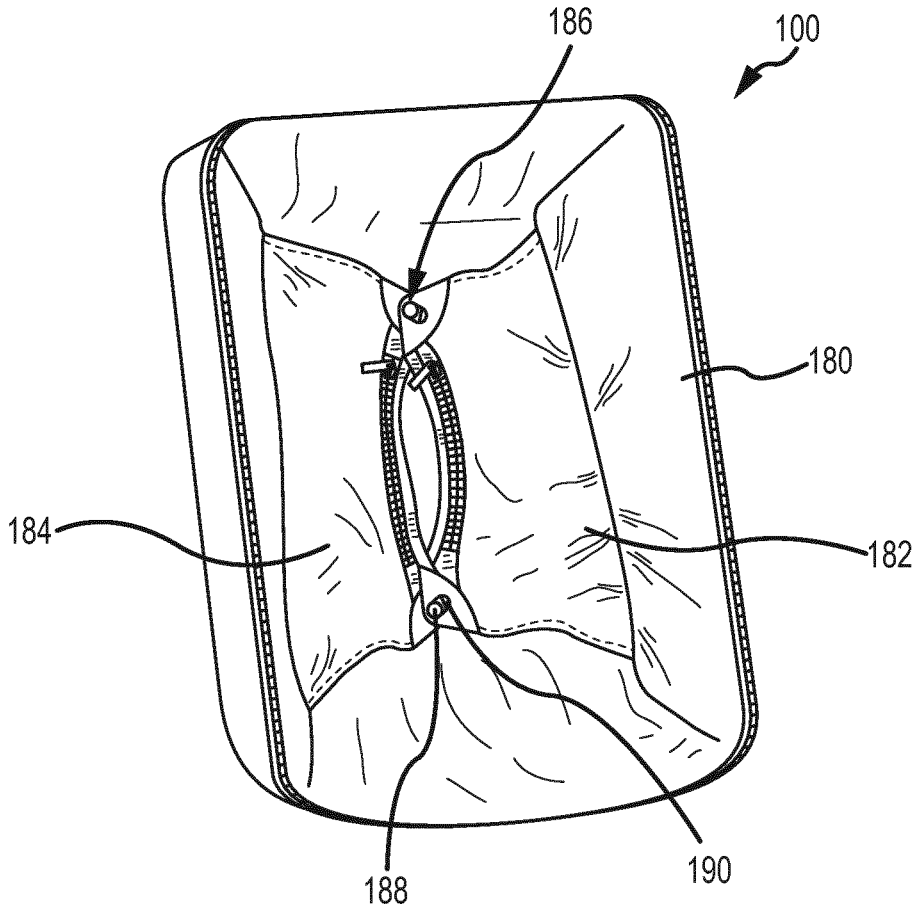
FIG. 8 shows a plan of the interior of the luggage piece shown in FIG. 1.
Figure 9:
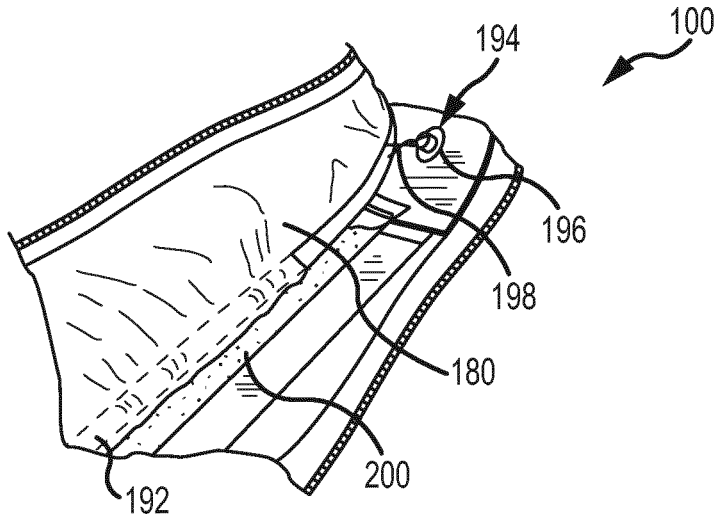
FIG. 9 shows a partial perspective view of the interior of the luggage piece shown in FIG. 1.

FIGS. 8 and 9 show one possible configuration for the interior of the luggage piece 100. With reference to these figures, a liner 180 or other inner layer of material may be positioned within the luggage piece 100. The liner 180 may substantially cover the inner surfaces of the lid or the base. A first flap 182 and a second flap 184 may be joined to the liner 180. Each flap 182, 184 may be generally trapezoidal or any other desired shape. The first flap 182 may be joined to the liner 180 along the right side 110 of the luggage piece 100, and the second flap 184 may be joined to the liner 180 along the left side 112 of the luggage piece 100. The first flap 182 may extend from the right side 110 of the luggage piece 100 towards the left side 112 of the luggage piece 100 and terminate at a free end that is located a select distance from the right side 110 of the luggage piece 100. Similarly, the second flap 184 may extend from the left side 112 towards the right side 110 of the luggage piece 100 and terminate at a free end that is located a select distance from the left side 112 of the luggage piece 100. Further, the free ends of the first and second flaps 182, 184 may be positioned to be located proximate to each other.

The first and second flaps 182, 184 may include a connection mechanism 186 that allows the first and second flaps 182, 184 to be selectively connected to and disconnected from each other. The connection mechanism 186 may take the form of a pair of lock protrusions 188 and holes 190. Each lock protrusion 188 and hole 190 may be configured so that a lock protrusion 188 may be selectively received within a respective hole 190 to selectively keep the first and second flaps 182, 184 joined together. Each lock protrusion 188 and hole 190 may be further configured to allow a lock protrusion 188 to be selectively removed from the hole 190 to selectively disconnect the first flap 182 from the second flap 184. Each hole 190 may be defined in a plastic or other suitable material structure that is joined to the first flap 182, and each protrusion 188 may be formed as part of a plastic or other suitable material component that is joined to the second flap 184. In some embodiments, other connection mechanisms may be utilized in place of, in combination with, the lock protrusion and hole arrangement, including, but not limited to snap fasteners, hook-and-loop fasteners, or some combination thereof.

The first and second flaps 182, 184 and the inner facing surface of the lid 126 or the base 128 may collectively define a substantially enclosed area within the enclosed space when the first and second flaps 182, 184 are joined together. To allow for expandability of the enclosed area, the flaps 182, 184 may be formed from an elastic fabric or other elastic material. Use of elastic material may also allow for the flaps 182, 184 to be configured to press against clothing or other items that may be positioned within this substantially enclosed area. The positioning of items within the enclosed area may help to keep the items from shifting within the main luggage compartment and/or keep the items separated from other items placed within the main luggage compartment. Such positioning of the items within the enclosed area may also help keep the items from falling out of the luggage compartment when the lid 126 and base 128 are pivoted into an open configuration.

Turning to FIG. 9, the liner 180 may be joined to the structural elements 148, 150 that span between the upper and lower bodies 140, 142, 144, 146. In particular, a cover 192 or other suitable element may be wrapped at least partially around a structural element 148, 150 and then stitched or otherwise joined to the liner 180. The cover 192 and the liner 180 collectively define an elongated cavity through with a respective structural element 148, 150 may pass through, thus effectively joining the liner 180 to the structural element 148, 150.

With continued reference to FIG. 9, at the upper and lower corners of the liner 180, the liner 180 may be joined to respective upper and lower bodies 140, 142, 144, 146 by liner connection mechanisms 194. Each liner connection mechanism 194 may take the form of a suction cup 196 and a flexible member 198, such as a wire, string, or rope. The flexible member 198 may span between the suction cup 196 and the liner 180 and may be joined at one end to the liner 180 and at a distal end to the suction cup 196. The suction cup 196, in turn, may be joined to a respective upper or lower body 140, 142, 144, 146 proximate to a corner region of the upper or lower body 140, 142, 144, 146. To keep the suction cup 196 joined to its respective upper or lower body 140, 142, 144, 146, an adhesive, such as glue or the like, may be used to adhere the suction cup 196 to the upper or lower body 140, 142, 144, 146. Thus, the flexible member 194 joins the liner 180 to a suction cup 196 that is joined to a respective corner region of the upper or lower body 140, 142, 144, 146, thus effectively joining the liner 180 to the corner region of the upper or lower body 140, 142, 144, 146. In other embodiments, other types of connection mechanisms may be used to join the liner 180 to a corner region of an upper or lower body 140, 142, 144, 146.

One or more foam layers 200 or the like may be positioned between the outer layer of material and a structural element 148, 150. The one or more foam layers 200 may be used to soften the exterior view of the luggage piece 100 or create a desired look for the exterior of the luggage piece 100, especially along the length of the structural element 148, 150. The one or more foam layers 200 may also be used to minimize the ability of the user to feel the structural element 148, 150 through the exterior facing surface of the luggage piece 100. In some embodiments that utilize multiple foam layers 200, one foam layer 200 may be co-extensive with the inner surface of the outer layer of material while the other foam layers 200 may be strips that are positioned to run along respective lengths of the structural elements 148, 150. In some embodiments, the foam layers 200 may be omitted.

Figure 10:
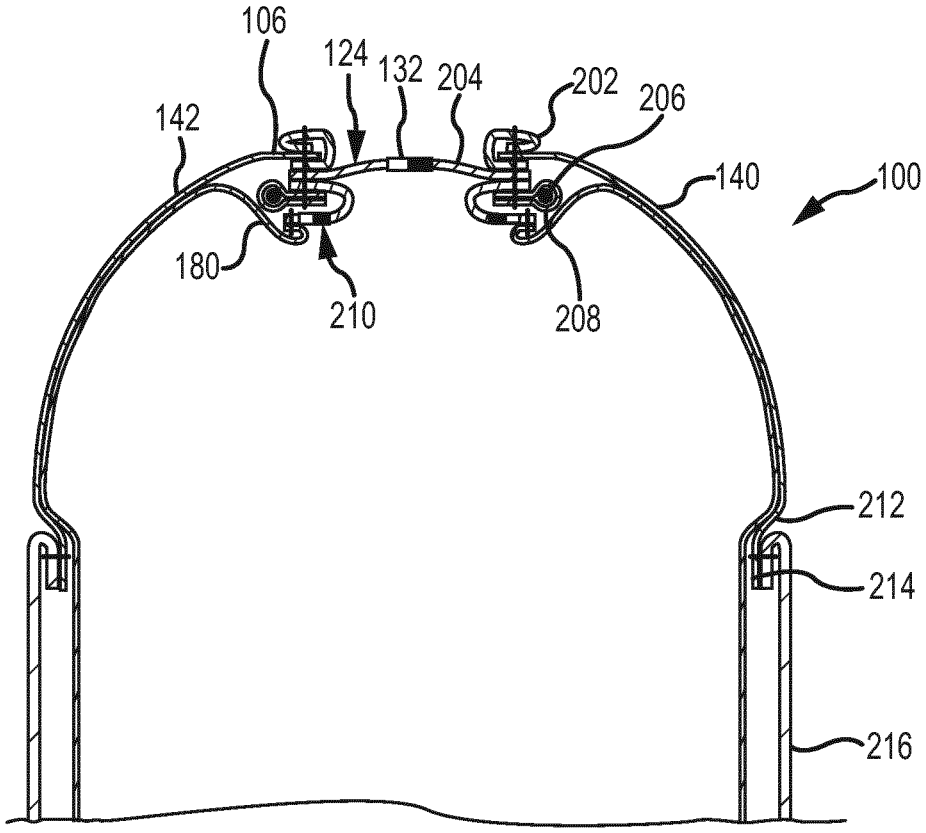
FIG. 10 shows a cross-section view of the luggage piece of FIG. 1, viewed along line 10-10 in FIG. 2.

With reference to FIG. 10, bindings 202 may be joined by stitching or another suitable connection method to respective first and second upper bodies 140, 142 at free ends of the first and second upper bodies 140, 142 where the zipper tapes 204 of the first zipper 124 are joined to the first and second upper bodies 140, 142. Each zipper tape 204 may then joined to an inner facing surface of a respective first upper body 140 and second upper body 142 by stitching or another suitable connection method. Because each zipper tape 204 is joined to the inner facing surface of a respective first upper body 140 or second upper body 142, the first and second sets of zipper teeth of the first zipper 124 are positioned at approximately the same elevation as the inner surfaces of the first and second upper bodies 140, 142. Thus, the zipper track 132 of the first zipper 124 is recessed relative to the outermost surface of the top side 106 of the luggage piece 100, resulting in at least a portion of the first zipper 124 being recessed relative to the outermost surface of the top side 106 of the luggage piece 100.

The portion of the first zipper 124 recessed relative to the outermost surface of the top side 106 of the luggage piece 100 is a function of the thickness of the first and second upper bodies 140, 142 and the thicknesses of the bindings 202. As the combined thickness of the first and second upper bodies 140, 142 and the bindings 202 increases, the portion of the first zipper 124 that is recessed relative to the outermost surface of the top side 106 of the luggage piece 100 increases. In some embodiments, the combined thickness of the first and second upper bodies 140, 142 and the bindings 202 is sufficiently large that the entire first zipper 124 is recessed relative to the outermost surface of the top side of the luggage piece 100. In other embodiments, the combined thickness of the first and second bodies 140, 142 and the bindings 202 may be selected so that a portion of the first zipper 124, usually an upper portion of the zipper slider 134, extends beyond the outermost surface of the top side 106 of the luggage piece 100.

In some embodiments, the bindings 202 may be omitted. In such embodiments, the amount of recess of the first zipper 124 relative to the outermost surface of the top side 106 of the luggage piece 100 would be a function solely of the thicknesses of the first and second upper bodies 140, 142. In these embodiments, the entire first zipper 204, or a portion of the first zipper 124, may be recessed relative to the outermost surface of the top side 106 of the luggage piece 100.

With continued reference to FIG. 10, the luggage piece 100 may include first support members 206, such as wires or the like, to provide additional structural support to the first and second upper bodies 140, 142 proximate to the first zipper 124. Each support member 206 of the luggage piece 100 may be placed in a cover 208 formed from a fabric, rubber or other suitable material to facilitate stitching or otherwise joining the support member 206 to the first zipper 124 and a respective first or second upper body 140, 142.

The luggage piece 100 may further include interior zippers 210 that are positioned adjacent to the first zipper 124. Each interior zipper 210 may be joined to one of the support members 206, the first zipper 124 and one of the first or second upper bodies 140, 142 by stitching or another suitable connection method. Each interior zipper 210 may be used to selectively join and disconnect the lining 180 to one of the first or second upper bodies 140, 142. In some embodiments, the interior zippers 210 may be omitted, and the lining 180 may be relatively permanently joined to a respective first zipper 124, support member 206, and first or second upper body 140, 142 by stitching or another suitable connection method.

Figure 6:
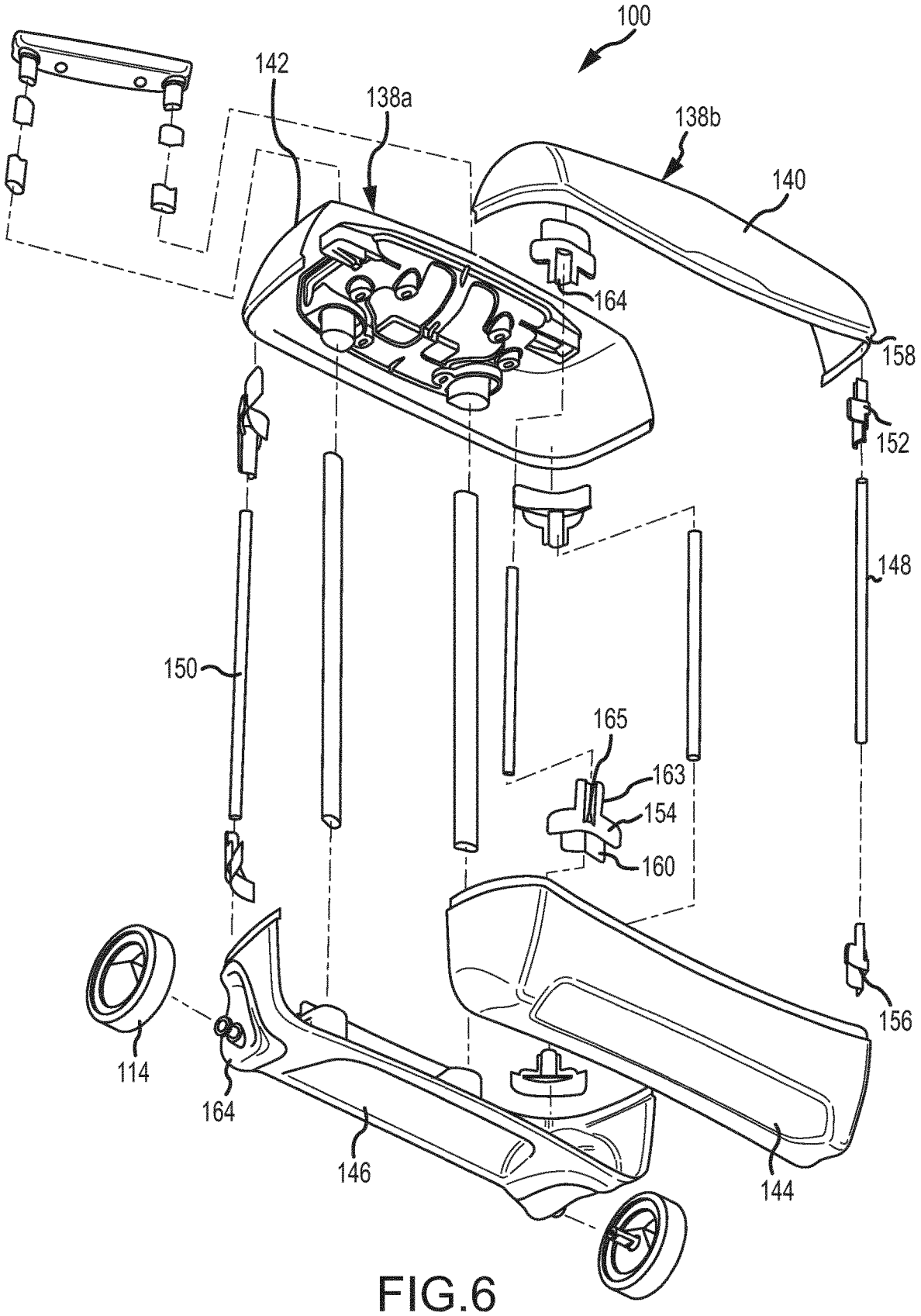
FIG. 6 shows an exploded perspective view of the frame shown in FIG. 4.
Figure 7:
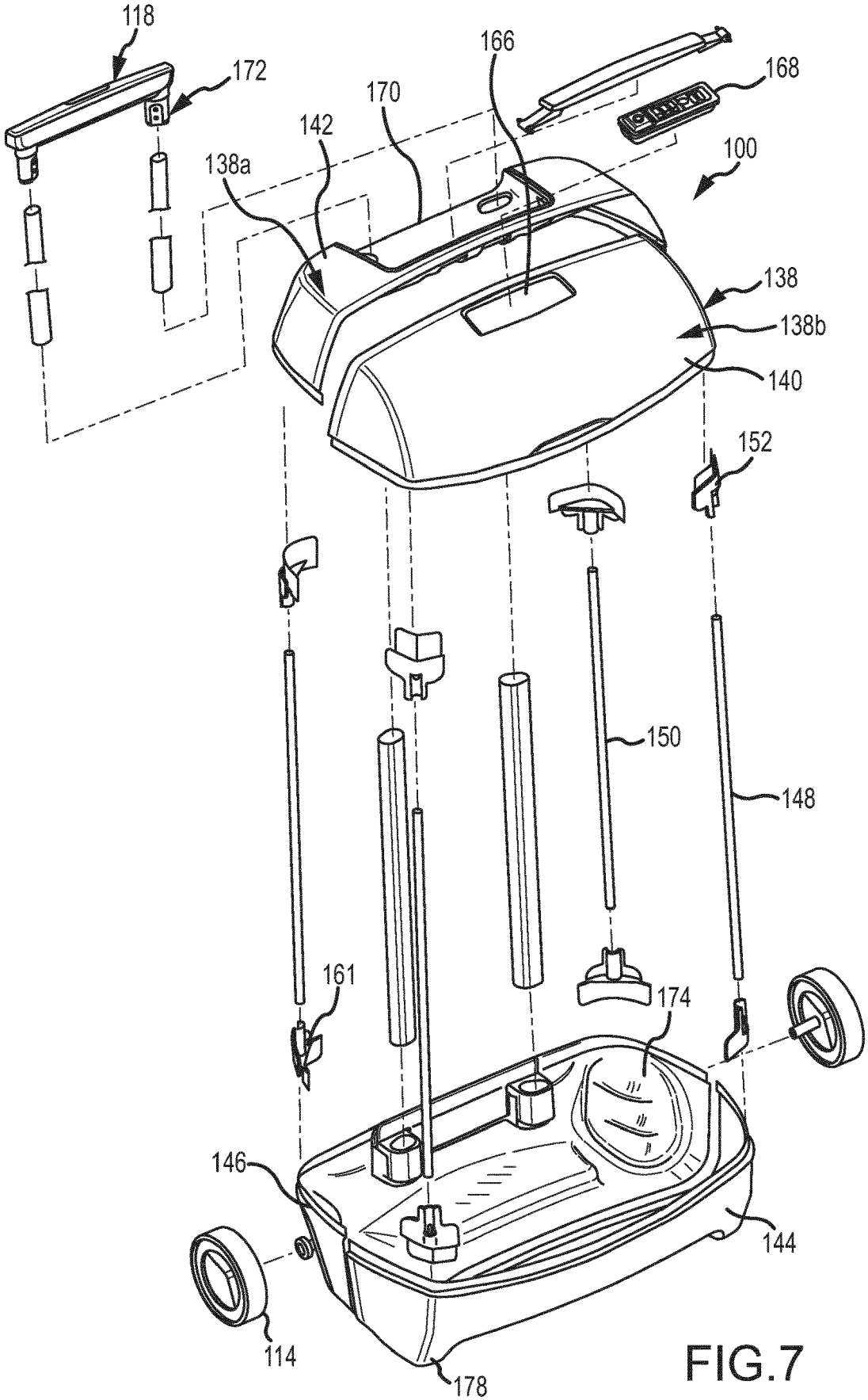
FIG. 7 shows another exploded perspective view of the interior of the luggage piece shown in FIG. 1.

Referring to FIGS. 6, 7 and 10, each first and second upper body 140, 142 may include a recessed area that is defined by a sidewall 212 and a flange 214 formed near a free end of the first or second upper body 140, 142 that is the distal the free end that is joined to the first zipper 124. The outer member or layer 216, which may formed from a fabric or other softer material, may be joined by a suitable connection method (e.g., stitching) to a respective first or second upper body 140, 142 proximate to this recessed free end. By recessing the free end where the outer member 216 is joined to a respective first or second upper body 140, 142, the outer surfaces of the outer member 216 and the respective first or second upper body 140, 142 can be positioned within approximately the same plane at the location of the transition between the outer surfaces of the respective first and second upper bodies 140, 142 and the outer members 216. Such recessing of the first and second upper bodies 140, 142 also allows the respective outer members 216 to be folded upon themselves where they are joined to the first or second upper bodies 140, 142 without it being visible from the outside of the luggage piece 100 that the outer members 216 are thicker in these regions than in other regions.

While the connections of the first zipper 124 and outer members 216 have been shown and described with reference to the first and second upper bodies 140, 142 of the luggage piece 100, the first zipper 124 and the outer members 216 may be joined to any of the lower bodies 144, 146 of the luggage piece 100 in a similar manner. Further, the joining of the linings 180, interior zippers 210, and support members 206, if any, to any lower body 144, 146 may be done in a similar manner as described above and shown in FIG. 10 for the first and second upper bodies 140, 142 of the luggage piece 100.

Figure 11:
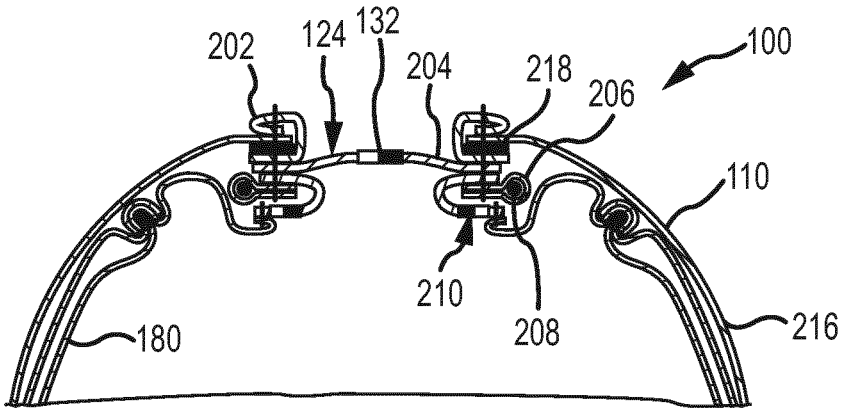
FIG. 11 shows a cross-section view of the luggage piece of FIG. 2, viewed along line 11-11 in FIG. 2.

With reference to FIG. 11, the first zipper 124 may also be recessed within the softer regions of the luggage piece 100. In these softer regions, the technique to recess the first zipper 124 is similar to the technique used in the harder regions except the upper and lower bodies 140, 142, 144, 146 are replaced with the outer members 216, which define the outer surface of the luggage piece 100 in the softer regions, and second support members 218 that are positioned between the zipper tapes 204 of the first zipper 124 and the inner surfaces of the outer members 216. Thus, in these softer regions, the recess of the first zipper 124 relative to the outermost surface of the right side 110 of the luggage piece 100 is a function of the thickness of the bindings 202, the outer members 216, and the second support members 218. As the combined thickness of the bindings 202, the outer members 216, and the second support members 218 increases, the portion of the first zipper 124 that is recessed relative to the outermost surface of the right side 110 of the luggage piece 100 increases. In some embodiments, the combined thickness of the bindings 202, the outer members 216, and the second support members 218 is sufficiently large that the entire first zipper 124 is recessed relative to the outermost surface of the right side 110 of the luggage piece 100. In other embodiments, the combined thickness of the bindings 202, the outer members 216, and the second support members 218 may be selected so that a portion of the first zipper 124, usually an upper portion of the zipper slider 134, extends beyond the outermost surface of the right side 110 of the luggage piece 100.

In some embodiments, the bindings 202 and/or the second support members 218 may be omitted. In embodiments where only the bindings 202 are omitted, the amount of recess of the first zipper 124 would be a function of the thicknesses of the outer members 216 and the second support members 218. In embodiments where only the second support members 218 are omitted, the amount of recess of the first zipper 124 would be a function of the thickness of the outer members 216 and the bindings 202. In embodiments where both the bindings 202 and the second support members 218 are omitted, the amount of recess of the first zipper 124 would be a function of the thickness of the outer members 216. In any of these embodiments, the entire first zipper 124, or a portion of the first zipper 124, may be recessed relative to the outermost surface of the right side 110 of the luggage piece 100.

The second support members 218 may take the form of ABS sheets, strips, or the like. Each second support member 218 may be an elongated strip or the like with the length of the strip running substantially parallel to the length of the zipper track 132. Further, each second support member 218 may run from an upper body 140, 142 to a lower body 144, 146. Each second support member 218 may have a generally rectangular cross-section along the length of the second support member 218. The rectangular cross-section advantageously creates relatively planar surfaces that abut the binding 202 and inner surface of the outer member 216. While the cross-section along the length of the second support member 218 is described and shown as being rectangular, any other desired cross-sectional shape, including trapezoidal or circular, may be used for the second support member.

Similar to the components used in the harder regions, one or more the following components may be joined to the outer members 216 and the first zipper 124 in the softer regions: first support members 206 to provide additional structural support, covers 208 to facilitate joining the first support members 206 to the other components, interior zippers 210 to selectively connect and disconnect linings 180 to the other components, and linings 180. As described above in connection with the harder regions, these other components may be joined by any suitable method to the outer members 216 and the first zipper 124. Further, when present, the interior zippers 210 may be positioned next the first zipper 124, the first zipper 124 may be positioned next to the bindings 202, the bindings 202 may cover the free ends of the outer members 216 that are proximate the first zipper 124, and the second support members 218 may be positioned between the first zipper 124 and the inner surface of the outer members 216.

Figure 12:
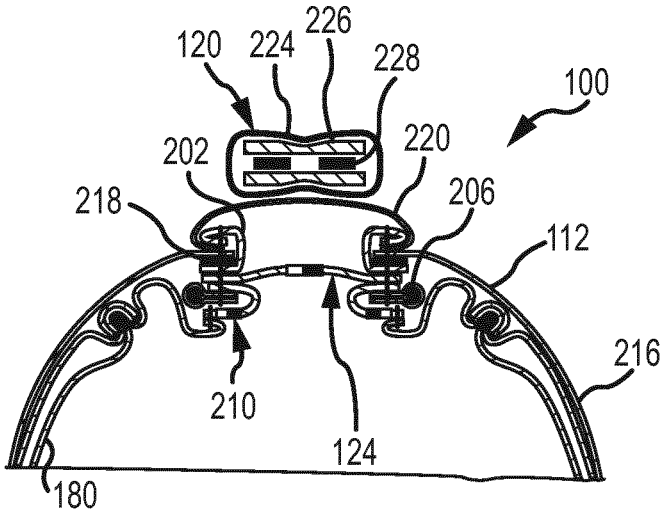
FIG. 12 shows a cross-section view of the luggage piece of FIG. 2, viewed along line 12-12 in FIG. 2.
Figure 13:
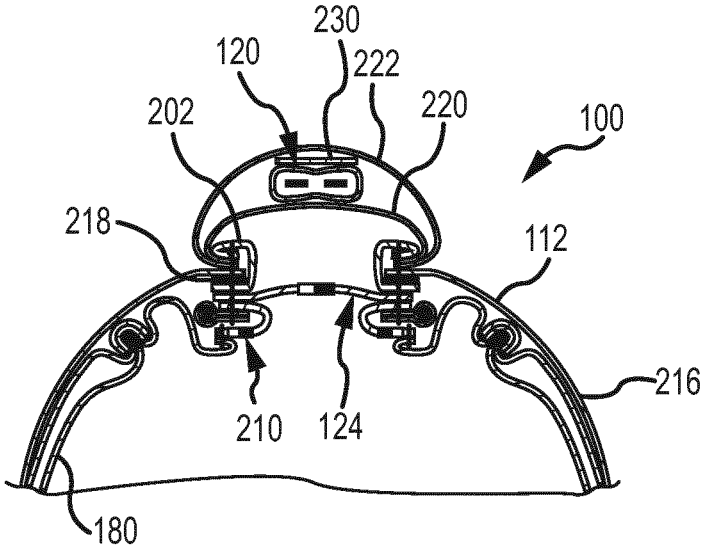
FIG. 13 shows a cross-section view of the luggage piece of FIG. 2, viewed along line 13-13 in FIG. 2.

Referring now to FIGS. 12 and 13, the first zipper 124 may also be recessed in the softer region on the left side 112 of the luggage piece 100. The first zipper 124 may be recessed in a manner similar to the method used in the softer region on the right side 110 of the luggage piece 100. More particularly, the first zipper 124 may be joined on the inner surfaces of the outer members 216 with bindings 202 and second support members 218 positioned between the first zipper 124 and the outer members 216. Further, the amount of recess of the first zipper 124 relative to the outermost surface of the left side 112 of the luggage piece 100 may be a function of the thickness of the outer members 216 and one or more of the thicknesses of the bindings 202 and the second support members 218. Additionally, to hinge together the lid 126 and the base 128 of the luggage piece 100, one or more hinge members 220, 222 may be joined to the outer members 216 that define the outer surfaces of the base and the lid 126 of the luggage piece 100 in the softer region. When one or more hinge members 220, 222 are used, the amount of recess of the first zipper 124 may further be a function of the thicknesses of the hinge members 220, 222. As with the right side 110 of the luggage piece 100 in the softer regions, the bindings 202 or the second support members 218 may be omitted.

With reference to FIGS. 2 and 12, proximate the middle portion of the luggage piece 100 on the left side 112 of the luggage piece 100, a first hinge member 220 may be used to join the lid 126 and the base 128. With reference to FIGS. 2 and 13, closer to the harder regions of the luggage piece 100, first and second hinge members 220, 222 may be used to join the lid 126 to the base 128, with the second or outer hinge member 222 covering the first or inner hinge member 220. The hinge members 220, 222 allow the lid 126 and the base 128 of the luggage piece 100 to be selectively pivoted relative to each other while keeping the lid and the base joined together when the first zipper 124 is moved to a position where a substantial portion of the teeth of the first and second sets of teeth are disengaged. The hinge members 220, 222 may be formed from a flexible fabric or any other suitable material. Further, the hinge members 220, 222 may be sewn to the outer members 216 or joined by any other suitable connection method.

Similar to right side 110 of the luggage piece 100 in the softer regions, one or more the following components may be joined to the outer members 216 and the first zipper 124 in the softer regions on the left side 112 of the luggage piece 100: first support members 206 to provide additional structural support, covers 208 to facilitate joining the first support members 206 to the other components, interior zippers 210 to selectively connect and disconnect linings 180 to the other components, and linings 180. As described above in connection with the harder regions, these other components may be joined by any suitable method to the outer members 216 and the first zipper 124. Further, when present, the interior zippers 210 may be positioned next the first zipper 124, the first zipper 124 may be positioned next to the bindings 202, the bindings 202 may cover the free ends of the outer members 216 that are proximate to the first zipper 124, and the second support members 218 may be positioned between the first zipper 124 and the inner surface of the outer members 216.

Returning back to FIG. 2, a carry handle 120 may be joined to the luggage piece 100 on the hinged side of the luggage piece 100 in the softer region. Further, the carry handle 120 may be positioned so it is located above the first zipper 124 and so that the length of the carry handle 120 runs parallel to the length of the zipper track 124. Such positioning of the carry handle 120 over the first zipper 124 allows for the carry handle 120 to be positioned at approximately the center of the luggage piece 100 on the hinged side of the luggage piece 100 when the lid 126 and the base 128 are approximately the same size. Thus, a longitudinal axis of the carry handle 120 may be aligned with a centerline of the luggage piece 100. In some embodiments, the centerline of the luggage piece 100 may be a width centerline of the luggage piece 100. This may be beneficial in that it allows the carry handle 120 to be approximately aligned with the center of mass of the luggage piece 100 when the luggage piece 100 is moved using the carry handle 120.

Now turning back to FIGS. 12 and 13, the carry handle 120 may be positioned above the first hinge member 220 and below the second hinge member 222. Thus, within the middle portion of the luggage piece 100 on the hinged side, the carry handle 120 may be exposed for grasping by the user, while closer to the harder regions of the luggage piece 100, the carry handle 120 may be covered by the second hinge members 220. The carry handle 120 may include an outer handle member 224. The outer handle member 224 may be formed using a webbed fabric or other suitable material that is durable, elastic and/or flexible. The outer handle member 224 may be configured to define a tubular shape. The carry handle 120 may further include an inner handle member 226 that is positioned within the tubular cavity defined by the outer handle member 224. The inner handle member 226 may be a foam (e.g., EVA foam), a gel or another resilient and soft material and may be formed using two or more pieces of the material. The inner handle member 226 generally provides the user with more comfortable grip when carrying the luggage piece 100 using the carry handle 120.

Figure 14:
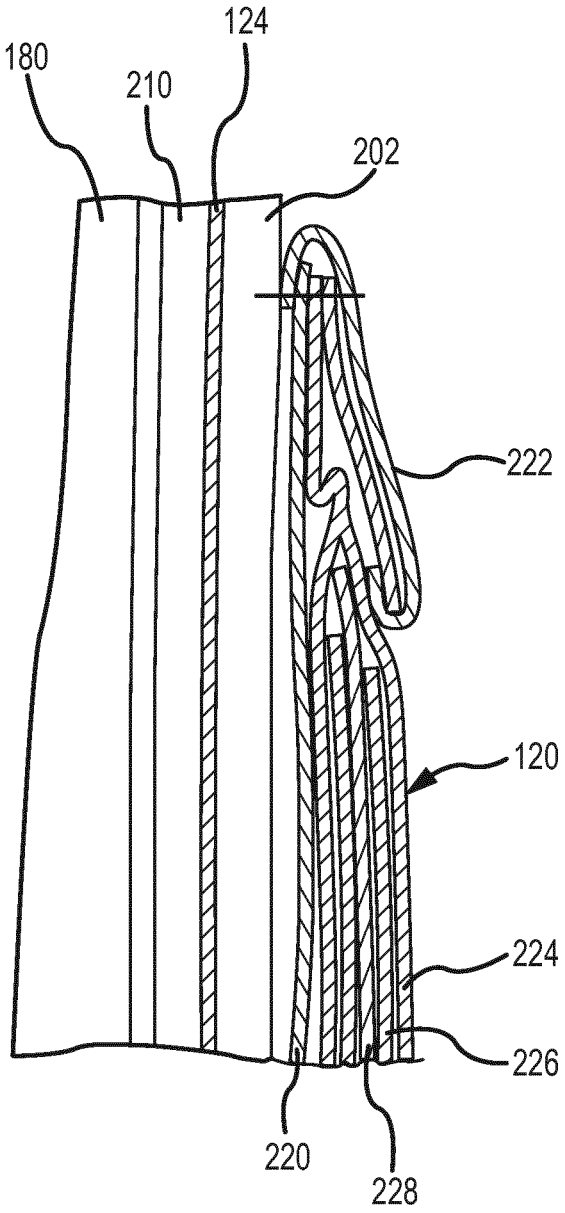
FIG. 14 shows a cross-section view of the luggage piece of FIG. 2, viewed along line 14-14 in FIG. 3.

With reference to FIGS. 12-14, the carry handle 120 may also include a biasing member 228 that is positioned with the tubular cavity defined by the outer handle member 224. The biasing member 228 may be configured to bias the carry handle 120 towards the outer surface of the luggage piece 100. The biasing member 228 may be one or more metal plates (e.g., steel plates) or other suitable structures that bias the carry handle 120 towards the outer surface of the luggage piece 100. Biasing the carry handle 120 towards the outer surface of the luggage piece 100 helps to reduce the dimensions of the luggage piece 100 when the carry handle 120 is not being used while allowing for the carry handle 120 to move away from the outer surface of the luggage piece 100 when grasped by a user in order to provide more space between the outer surface of the luggage piece 100 and the carry handle 120 for the user's hands. The biasing member 228 may be positioned to be at least partially, up to fully, surrounded by the inner handle member 226. Such positioning of the biasing member 228 relative to the inner handle member 226 may reduce the ability of the user to feel the biasing member 228 within the outer handle member 224 and/or protect the user's hand from the biasing member 228.

To facilitate movement of the carry handle 120 away from the outer surface of luggage piece 100, excess material that forms the outer handle member 224 may be placed within a cavity defined by the first and second hinge members 220. The excess material allows for the total length of the carry handle 120 that is exposed outside of the second hinge members 222 to be selectively increased and decreased. When increased, the amount of space between the outer surface of the luggage piece 100 and the inward facing surface of the carry handle 120 increases, thus providing more room for a user's hand. When decreased, the distance between the outer surface of the luggage piece 100 and the inward surface of the carry handle 120 decreases, thus bringing the carry handle 120 closer to the outer surface of the luggage piece 100. Further, because of the bias provided by the biasing member 228, when the carry handle 120 is released by the user, the biasing member 228 moves the carry handle 120 back towards the outer surface of the luggage piece 100.

With continued reference to FIG. 14, a rigid or semi-rigid handle support member 230 may be positioned within the cavity defined by the first and second hinge members 220, 222. The handle support member 230 may be positioned between the carry handle 120 and the second hinge member 222. The handle support member 230 may be used to provide structural strength at the ends of the carry handle 120. The handle support member 230 may be made of a plastic material, such as polypropylene or polyethylene, or any other suitable material.

The carry handle 120 may be joined to the first and second hinge members 220, 222 and the outer members 216 by stitching or any other suitable connection method. In particular, the end portions of the outer handle member 224 may be stitched or otherwise joined to the first and second hinge members 220, 222 and the outer members 216.

Figure 15:
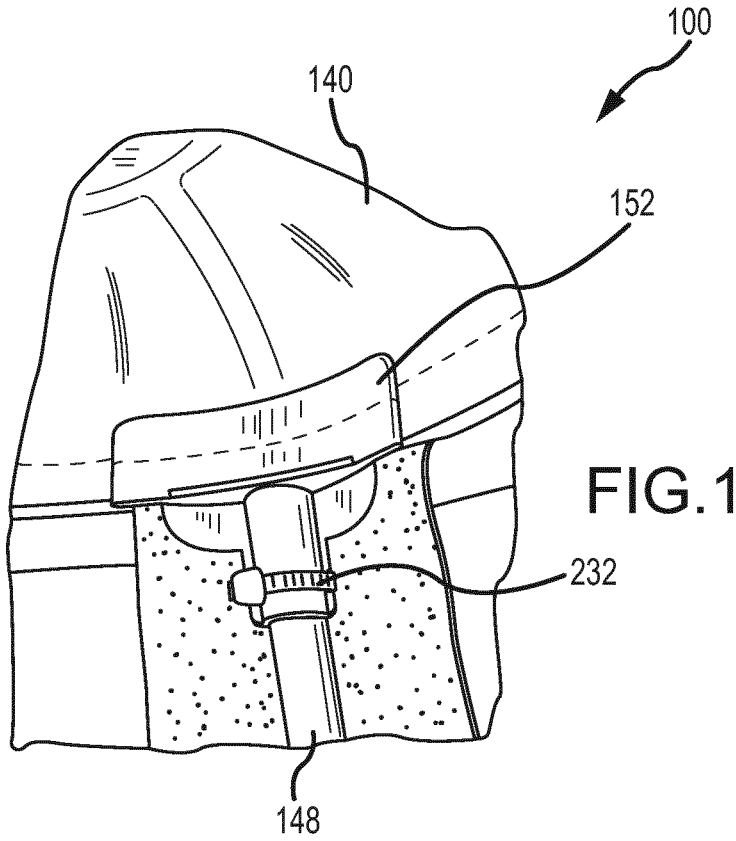
FIG. 15 shows a plan view of an upper portion of the luggage piece of FIG. 1 with an interior lining removed to show the connection of a structural element to an upper body.
Figure 16:
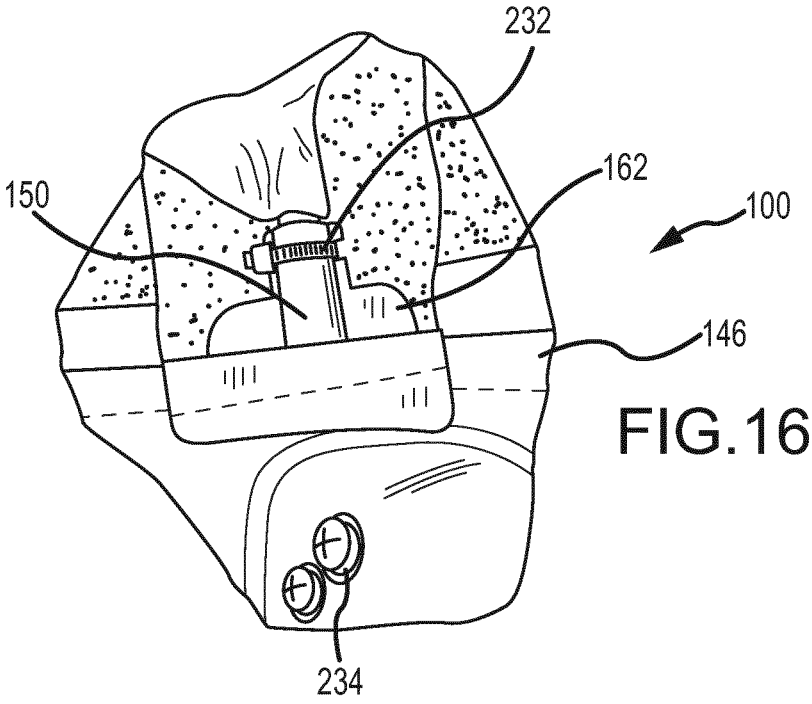
FIG. 16 shows a plan view of a lower portion of the luggage piece of FIG. 1 with an interior lining removed to show the connection of a structural element to a lower body.

FIGS. 15 and 16 show interior views of upper and lower portions of the luggage piece 100 with the liner 180 removed to show the structure underneath the liner 180. With reference to these figures, the structural connectors 152, 162 may be joined to respective upper and lower bodies 140, 142, 144, 146 by stitching or any other suitable connection mechanism. Further, if desired, friction connection members 232, such as a zip ties or the like, may be utilized to help keep the structural elements 148, 150 joined to their respective structural connectors 152, 162. In particular, a friction connection member 232 may be configured to define a loop that encompasses a collar 163 of a structural connector 152, 162. Once the structural element 148, 150 is positioned to abut the collar 163 of the structural connector 148, 150, the size of the loop may be decreased until the loop engages the collar 163 and the structural element 148, 150. The loop may be further decreased in size to cause the friction connection member 232 to press against the collar 163 and the structural element 148, 150, thus enhancing a friction force that resists sliding of the structural element 148, 150 relative to the structural connector 152, 162 along the length of the collar 163. This resistance to sliding movement may facilitate keeping the structural connector 152, 162 and the structural element 148, 150 joined to each other and may also help to maintain the relative positions of the structural element 148, 150 and the structural connector 152, 162 to each other.

With reference to FIG. 16, mechanical fasteners 234 may be used to join the wheel housings 164 to second lower body 146. The mechanical fasteners 234 may take the form of screws or the like. To join the wheels housings 164 to the second lower body 146, each mechanical fastener 234 may pass through a hole defined in the second lower body 146. If desired, connection methods other than, or in addition to, mechanical fasteners may be used to joined the wheel housings 164 to the second lower body 146.

Figure 17:
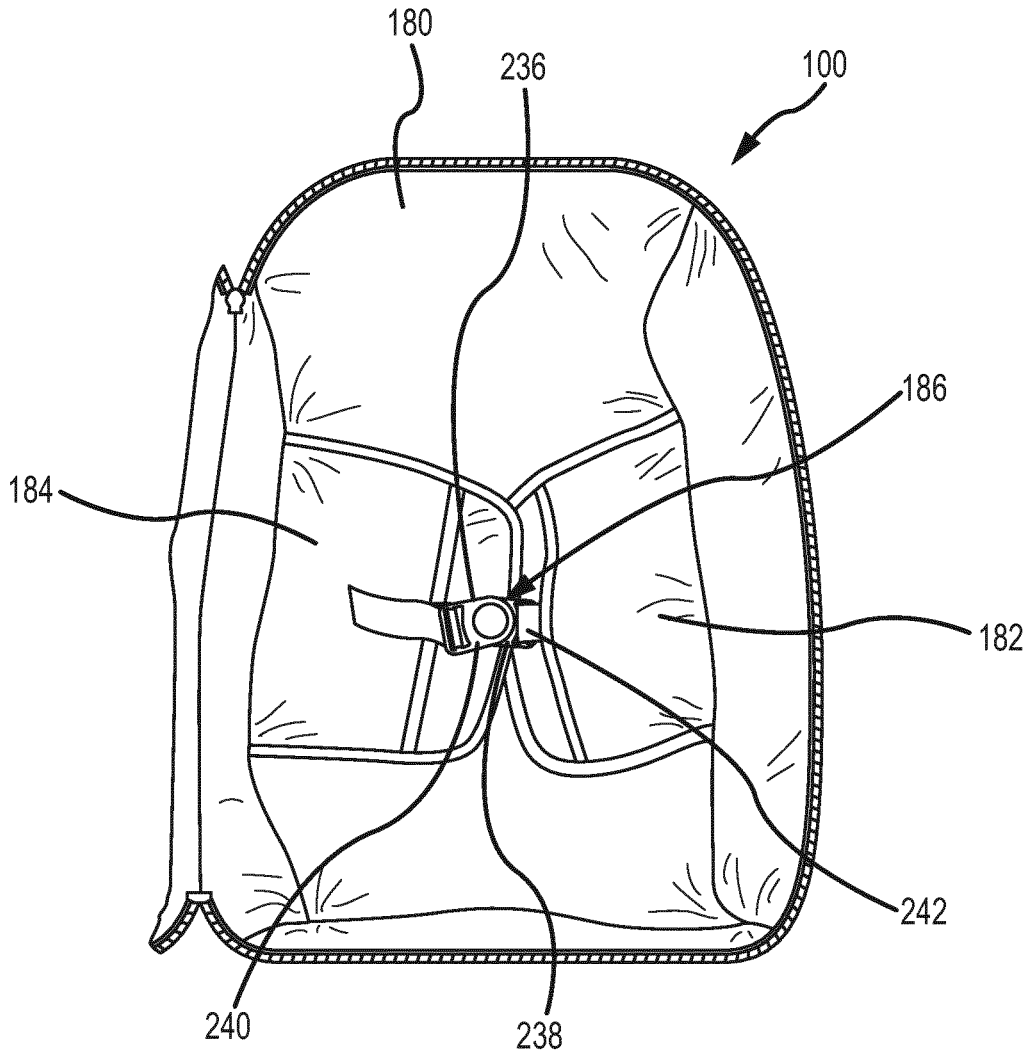
FIG. 17 shows a plan view of another possible interior for the luggage piece shown in FIG. 1.

FIG. 17 shows another possible interior for the luggage piece 100 of FIG. 1. Similar to the interior shown in FIG. 8, this second interior may include a liner 180 that substantially covers the interior surface of the luggage piece 100. Like the first interior, the second interior may also include a pair of flaps 182, 184 that may be selectively joined via a connection mechanism 186 to define an enclosed area within the enclosed space. In the second interior, however, the flaps 182, 184 may be generally rectangular in shape or any other desired shape. Further, the connection mechanism 186 may take the form of one or more tension buckles 236.

With reference to FIG. 17, a single tension buckle 236 may be positioned at approximately centers of the flaps and proximate to the free ends of the flaps 182, 184. In other embodiments, two or more tension buckles 236 may be utilized. In some embodiments that utilize two tension buckles 236, one tension buckle 236 may be joined towards an upper end of the flaps 182, 184 and the other tension buckle 236 may be joined towards a lower end of the flaps 182, 184. Further, in such embodiments, both tension buckles 236 may be joined to the flaps 182, 184 proximate the free ends of the flaps 182, 184.

With continued reference to FIG. 17, the tension buckle 236 may include a male buckle element 238 and a female buckle element 240. The male buckle element 238 may be joined to one flap 182, and the female buckle element 240 may be joined to the other flap 184. The male and female buckle elements 238, 240 may each be joined to their respective flaps 182, 184 by buckle flexible members 242. Each buckle flexible member 242 may take the form of a fabric strap (e.g., nylon strap) or the like or any other suitable material and shape. Further, each buckle flexible member 242 may be looped through a pair of flexible member slots defined in its respective buckle element 238, 240 and stitched or otherwise suitable joined to the flap 182, 184 associated with the buckle element 238, 240 to join each buckle element 238, 240 to its respective flap 182, 184.

One of the buckle flexible members 242 may be longer than other buckle flexible member 242. The longer flexible member 242 may be joined to either the female buckle element 240 or the male buckle element 238 and may be used to selectively adjust the size of the enclosed area defined by the flaps 182, 184 and the interior surface of the luggage piece 100. In particular, pulling the longer buckle flexible member 242 through the slots in one direction will decrease the size of the enclosed area, while pulling it through the slots in the opposite direction will increase the size of the enclosed area. The ability to change the size of the enclosed area allows the flaps 182, 184 to be pressed against objects placed within the enclosed area to help maintain the objects within the enclosed area. This also allows the flaps 182, 184 to be selectively moved away from objects placed within the enclosed area without having to disconnect the flaps 182, 184 from each other. This may be done to allow objects to be readily removed from the enclosed area without disconnecting the flaps 182, 184 or to allow additional objects to be placed within the enclosed area without disconnecting the flaps 182, 184.

Figure 18:
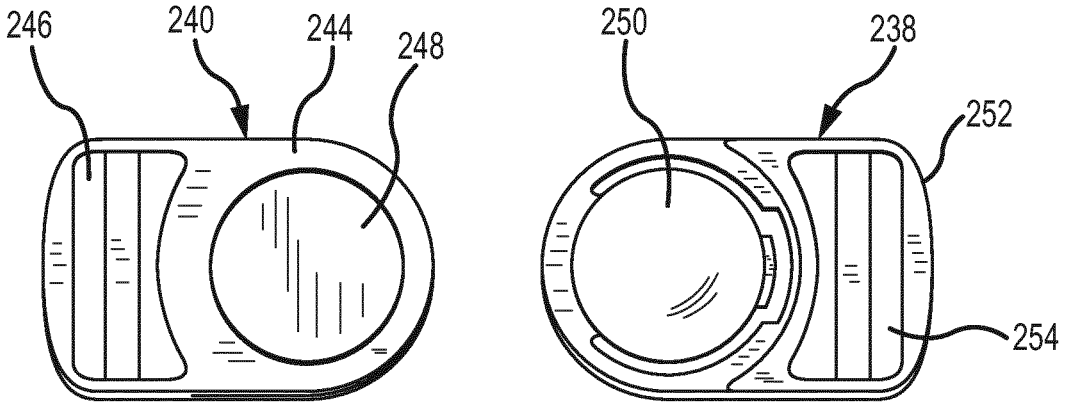
FIG. 18 shows a top view of a buckle for a connection mechanism that may be utilized for the interior shown in FIG. 17.
Figure 19:
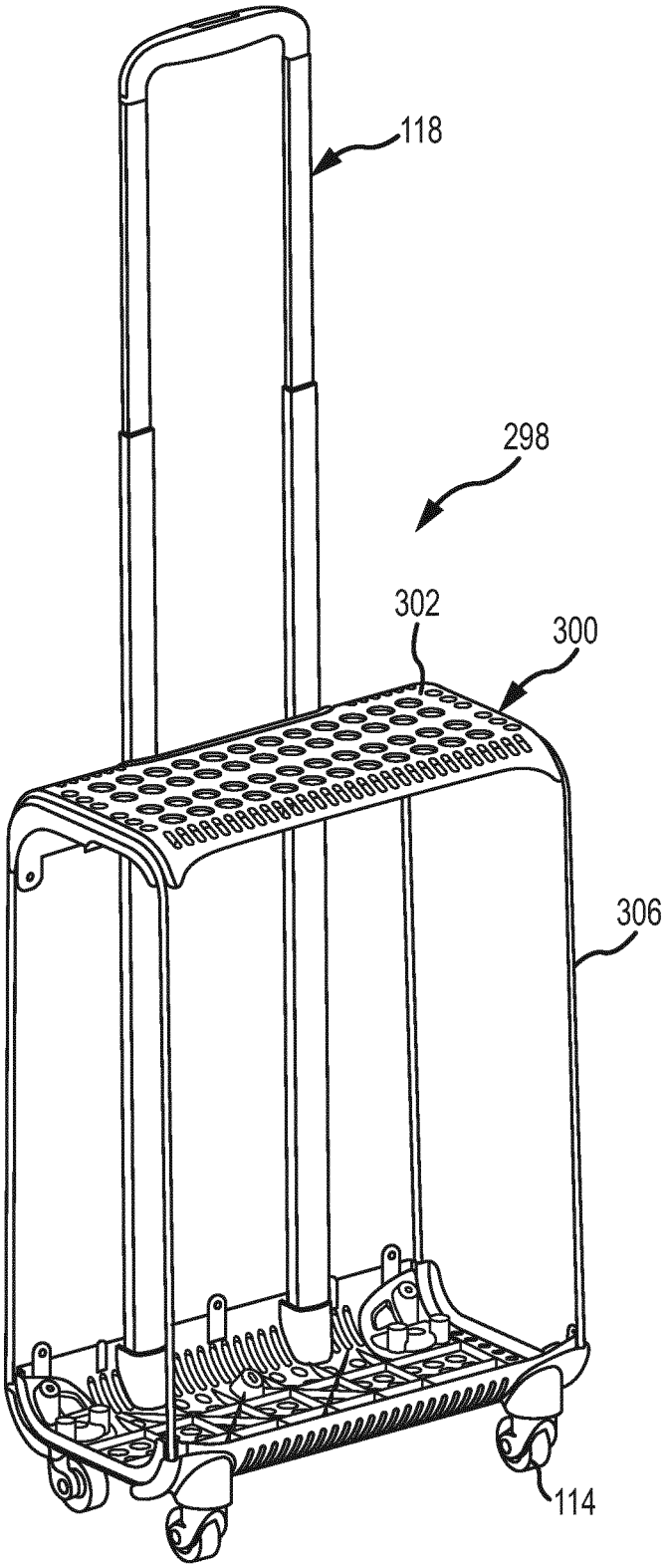
FIG. 19 shows a front perspective of a second frame for a luggage piece.
Figure 20:
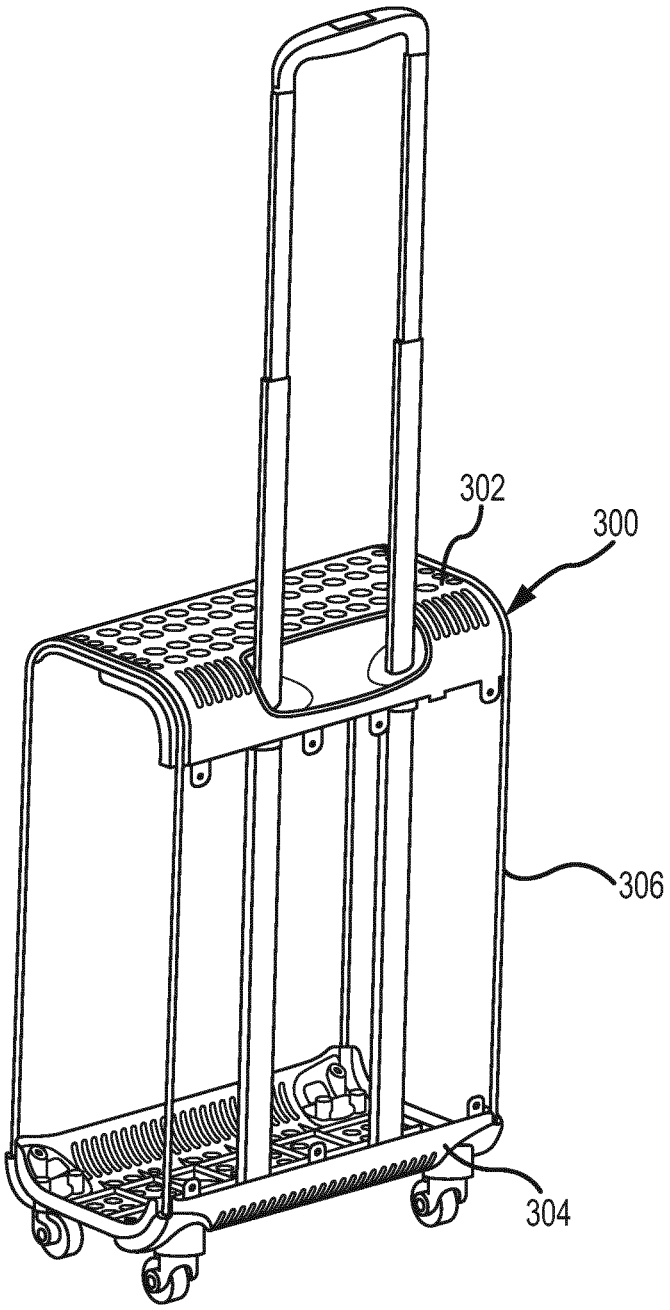
FIG. 20 shows a rear perspective view of the second frame shown in FIG. 19.
Figure 22:
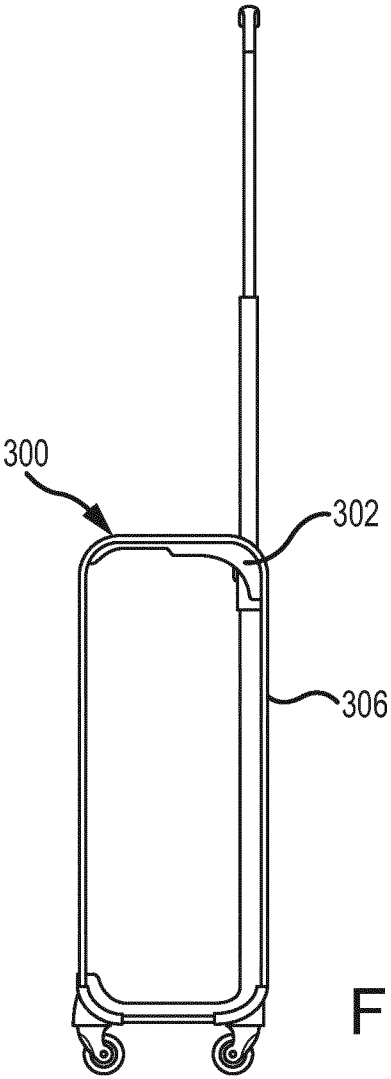
FIG. 22 shows a side elevation view of the second frame shown in FIG. 19.
Figure 21:
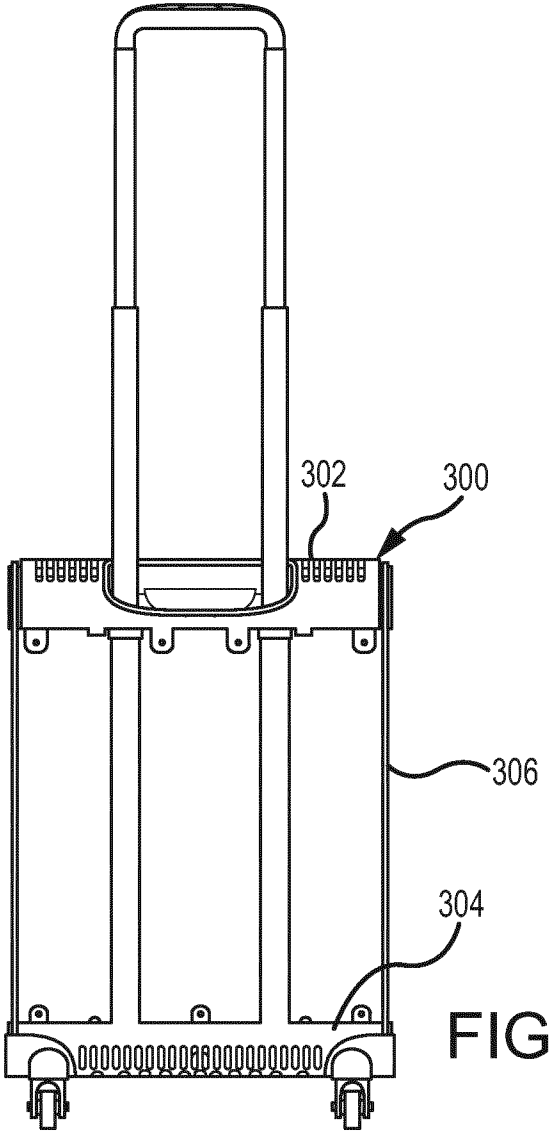
FIG. 21 shows a rear elevation view of the second frame shown in FIG. 19.

Turning to FIG. 18, the female buckle element 240 may include a female buckle body 244 that defines the flexible member slots 246 proximate to a rear side of the female buckle element 240. The female buckle body 244 may further define a release mechanism slot that is in communication with a release mechanism aperture 248 that is also defined by the female buckle body 244. The release mechanism slot may be sized to receive therethrough a release mechanism 250 that is joined to the male buckle element 238.

The release mechanism slot may be generally U-shaped along its length. Further, the release mechanism slot may extend along a first side of the female buckle body 244 to a front side of the female buckle body 244, along the front side to the female buckle body 244 to a second side of the female buckle body 244 that is substantially parallel to and distal the first side, and along the second side of the female buckle body 244 towards the rear side of the female buckle body 244. The front side of the female buckle body 244 may be generally arcuate or any other desired shape, and the first and second sides of the female buckle body 244 may be generally linear or any other desired shape.

The release mechanism aperture 248 may be positioned within and defined by a top side of the female buckle body 244. The release mechanism aperture 248 may be generally circular or any other desired shape that generally matches the shape of the release mechanism 250. Further, the release mechanism aperture 248 may be sized to receive at least a portion of the release mechanism 250 therethrough. Positioning at least a portion of the release mechanism 250 through the release mechanism aperture 248 joins to the male buckle element 238 to the female buckle element 240.

The male buckle element 238 may include a male buckle body 252 that defines its flexible member slots 254. The male buckle body 252 may further define the release mechanism 250 that is selectively positioned within the release mechanism aperture 248. The release mechanism 250 may take the form of a button or the like that is joined to the rest of the male buckle body 252 via a living hinge 256 or the like. The living hinge 256 may join the release mechanism 250 to a front side of the male buckle element 238. If desired, the release mechanism 250 may be joined to any of a first side, a second side that is parallel to and distal the first side, or a rear side of the male buckle body 252. Similar to the female buckle element 240, the front side of the male buckle element 238 may be generally arcuate or any other desired shape, and the first and second sides of the male buckle element 238 may be generally linear or any other desired shape.

The living hinge 256 may be configured to bias the release mechanism 250 in a direction upward and away from a top side of the male buckle body 252. The living hinge 256 may further be configured to allow the release mechanism 250 to be pressed or otherwise moved in a downward direction towards the remaining portion of the male buckle body 252. The release mechanism 250 may be partial spherical in shape or any other desired shape that generally matches the shape of the release mechanism aperture 248.

To join the male buckle element 238 with the female buckle element 240, the front side of the male buckle element 238 may be moved through the release mechanism slot and towards the rear side of the female buckle element 240. As the male buckle element's front side passes through the release mechanism slot and towards the rear side of the female buckle element 240, the release mechanism 250 may move downward towards the male bucket body 252 until it is generally located at the same elevation as the release mechanism slot. This alignment allows the male buckle element 238 to continue to be moved towards the female bucket element 240 until the release mechanism 250 generally aligns, as viewed from above, with the release mechanism aperture 248. At this position, the release mechanism 250 moves upward by the bias of the living hinge 256, thus causing at least a portion of the release mechanism 250 to pass through the release mechanism aperture 248. Once at least a portion the release mechanism 250 passes through the release mechanism aperture 248, the male and female buckets elements 238, 240 are joined to each other.

To disconnect the male buckle element 238 from the female buckle element 240, the release mechanism 250 may be pressed downward towards the remaining portion of the male buckle body 252 until the release mechanism 250 is generally located at the same elevation as the release mechanism slot. The male bucket element 238 may then be moved away from the female buckle element 240, or vice versa, through the release mechanism slot until the entire male buckle element 238 is removed from the female buckle element 240. Once the male buckle element 238 is removed from the female buckle element 240, the male and female bucket elements 238, 240 are no longer joined. This in turn disconnects the flaps 182, 184, thus allowing each flap 182, 184 to be pivoted or otherwise moved relative to the lining 180 independent of the other flap 182, 184.

FIGS. 19-22 shows various views of a second frame 300 for a luggage piece 298. The second frame 300 may be generally similar to the first luggage frame 138. For example, the second frame 300 may generally form the structural support for a base of the luggage piece. As such, the second frame 300 may include an upper or first body 302 and a lower or second body 304 and one or more structural elements 306. Further, the upper and lower bodies 302, 304 may be formed from similar materials and may be shaped by a molding or other similar process. However, despite these similarities, a luggage piece 298 that utilizes the second frame 300 may be slightly different than a luggage piece 100 that utilizes the first luggage frame 138, thus resulting in the second frame 300 being slightly different than the first luggage frame 138.

More particularly, a luggage piece 298 that utilizes the second frame 300 may also utilize a move conventional lid (not shown) where the primary purpose of the lid is to allow and limit access to the main compartment. As such, the lid may be formed using a more conventional construction, as known in the art, that typically involves use of fabrics, wires or hoops, and possibly polypropylene or polyethylene sheets. Further, the base itself may define a substantial portion of the enclosed space. Accordingly, the upper or first body 302 of the second frame 300 may define, or be co-extensive with, substantially the entire top side or face 106 of the luggage piece 298. Similarly, the lower or second body 304 of the second frame 300 may define, or be co-extensive with, substantially the entire bottom side or face 108 of the luggage piece 298, which is generally distal from the top side or face 106 of the luggage piece 298. Each of the upper and lower bodies 302, 304 may further define, or be co-extensive with, at least portions of the front and rear sides or faces 102, 104 of the luggage piece 298.

Like the upper bodies 140, 142 for the first luggage frame 138, the upper or first body 302 for the second frame 300 may include a handle recess area or the like configured to allow a telescoping handle 118 to be joined to the upper or first body 302. Similarly, as with the lower bodies 144, 146 for the first luggage frame 138, the lower or second body 304 for the second frame 300 may include various features that allow for wheels 114 and the telescoping handle 118 to be joined to the lower or second body 304 for the second frame 300. To reduce the weight of the first and second bodies 302, 304, multiple holes may be formed in the first and second bodies 302, 304.

The structural elements 306 for the second frame 300 may also differ from the structural elements 148, 150 for the first luggage frame 138. Specifically, each structural element 306 may be an elongated member that is formed into a hoop or loop shape. Each elongated member may be formed from a flexible wire or the like, such as a steel wire. To facilitate joining the structural elements 306 to upper and lower bodies 302, 304, each upper and lower body 302, 304 may include grooves or the like that receive at least a portion of one of the structural elements 306 therein. Each such groove may be defined at the end portions of their respective first and second bodies 302, 304 that are proximate to the right and left sides or faces 110, 112 of the luggage piece 298 so that each structural element 306 may be located proximate to either the left or right side or face 110, 112 of the luggage piece 298.

The above-described examples of luggage frames offer many potential advantages over previous luggage frames. For example, the various upper and lower bodies for the luggage frames described herein may be shaped into desired forms, thus providing a luggage designer with flexibility regarding the exterior appearance of the luggage piece. The various upper and lower bodies for the luggage frames described herein may also include integrated features for supporting telescoping handles and luggage wheels, thus potentially simplifying the manufacture and/or the construction of the luggage pieces by reducing the number of pieces that need to be manufactured or assembled. The use of the luggage frames described herein may also allow for relatively sturdy material to be positioned in areas susceptible to impact forces or damage, while lighter fabric materials and polyolefin sheets may be used in less critical areas, thus helping to reduce the weight of the luggage piece while also maintaining sufficient durability and/or structural integrity for the luggage piece. Some or all of these potential advantages may be present in the various luggage pieces that are constructed in accordance with the luggage frames described herein. Further, one of ordinary skill in the art would recognize other potential advantages associated with the luggage frames and luggage pieces described herein.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the scope of the invention as defined in the appended claims.

What is claimed is:

1. A luggage piece, comprising:

a base comprising a frame;

a lid pivotally joined to the base to pivot between at least a first position where the base and the lid define a substantially enclosed space and a second position that allows for access to the substantially enclosed space;

at least one wheel coupled to a wheel housing; and the frame comprising:

two wire loops;

a first molded, hard body defining a groove to receive at least a portion of one of the wire loops, the groove defined by a bottom wall and two side walls;

a second molded, hard body receiving at least a portion of one of the wire loops, the second, molded hard body positioned at a portion of the base that is distal from the first molded, hard body;

the first molded, hard body further defines at least a significant portion of a face of the base;

the second molded, hard body defines at least a significant portion of another face of the base;

the first molded, hard body joined to the second molded, hard body by at least said two wire loops; and wherein the second molded, hard body receives at least a portion of one of the wire loops at a location defined in an end portion of the second molded, hard body between at least a portion of the wheel housing and the end portion.

2. The luggage piece of claim 1, wherein a top face of the base is the face of the base that is at least significantly defined by the first molded, hard body.

3. The luggage piece of claim 1, further comprising an outer layer joined to the frame.

4. The luggage piece of claim 3, wherein the outer layer comprises a fabric.

5. The luggage piece of claim 3, wherein the outer layer defines a central portion of yet another face of the base where the central portion is located between the first and second molded, hard bodies.

6. The luggage piece of claim 1, wherein each of the first and second molded, hard bodies defines portions of at least two other faces of the luggage piece.

7. The luggage piece of claim 6, wherein the at least two other faces are selected from the group consisting of the following: a front face or a rear face, of the luggage piece.

8. The luggage piece of claim 6, wherein:

the first molded, hard body further defines portions of the top, rear, and front faces of the luggage piece; and the second molded, hard body further defines portions of the bottom, rear, and front faces of the luggage piece.

9. The luggage piece of claim 1, wherein a bottom face of the base is the another face of the base that is at least significantly defined by the second molded, hard body.

10. The luggage piece of claim 1, wherein the first molded, hard body and the second, molded hard body are selected from acrylonitrile-butadiene-styrene ("ABS") plastic, polycarbonate plastic, or an ABS/polycarbonate plastic blend.

11. The luggage piece of claim 1, wherein the groove is defined at the end portion of the respective molded hard body.

12. The luggage piece of claim 11, wherein the end portion is proximate the right or left face of the luggage piece.

13. The luggage piece of claim 12, wherein when at least one of the two wire loops is received in the groove, the wire loop is located proximate the right or left face of the luggage piece.

14. The luggage piece of claim 1, wherein each of the two wire loops is a supporting wire that forms the frame to provide structural support to the first and second molded, hard bodies.

15. The luggage piece of claim 1, wherein each wire loop is positioned along exterior surfaces of the first and second molded, hard bodies, the exterior surfaces of the first and second molded, hard bodies defining at least top and bottom faces of the base, respectively.

16. The luggage piece of claim 1, wherein a second groove is defined at least partially by a wheel housing.

17. The luggage piece of claim 16, wherein the second groove is defined at least partially between the wheel housing and the second molded, hard body.

* * * * *